US007162189B2

(12) United States Patent
Tsuda et al.

(10) Patent No.: US 7,162,189 B2
(45) Date of Patent: Jan. 9, 2007

(54) METHOD AND APPARATUS OF IMAGE FORMING AND PROCESS CARTRIDGE INCLUDED IN THE APPARATUS

(75) Inventors: Kiyonori Tsuda, Kanagawa-ken (JP); Atsushi Sampe, Kanagawa-ken (JP); Takeo Suda, Tokyo (JP); Satoshi Hatori, Kanagawa-ken (JP); Yuji Arai, Kanagawa-ken (JP); Tomoji Ishikawa, Kanagawa-ken (JP); Naoto Watanabe, Chiba-ken (JP)

(73) Assignee: Ricoh Company, Ltd., Tokyo (JP)

( * ) Notice: Subject to any disclaimer, the term of this patent is extended or adjusted under 35 U.S.C. 154(b) by 155 days.

(21) Appl. No.: 10/792,694

(22) Filed: Mar. 5, 2004

(65) Prior Publication Data

US 2005/0281590 A1 Dec. 22, 2005

(30) Foreign Application Priority Data

Mar. 5, 2003 (JP) ..... 2003-059126

(51) Int. Cl.
*G03G 15/08* (2006.01)

(52) U.S. Cl. ..... 399/258

(58) Field of Classification Search ..... 399/252, 399/258, 262; 222/167, DIG. 1
See application file for complete search history.

(56) References Cited

U.S. PATENT DOCUMENTS

| | | | |
|---|---|---|---|
| 4,969,015 | A | 11/1990 | Sanpe |
| 5,109,254 | A | 4/1992 | Oka et al. |
| 5,235,384 | A | 8/1993 | Oka et al. |
| 5,386,274 | A | 1/1995 | Sanpe et al. |
| 5,416,568 | A | 5/1995 | Yoshiki et al. |
| 5,532,795 | A | 7/1996 | Tatsumi et al. |
| 5,552,877 | A | 9/1996 | Ishikawa et al. |
| 5,565,973 | A | 10/1996 | Fujishiro et al. |
| 5,614,998 | A | 3/1997 | Sanpe |
| 5,617,198 | A | 4/1997 | Ishikawa et al. |
| 5,638,158 | A | 6/1997 | Sanpe et al. |
| 5,646,721 | A | 7/1997 | Sugihara et al. |
| 5,659,860 | A | 8/1997 | Sasaki et al. |
| 5,663,788 | A | 9/1997 | Sanpe |
| 5,671,470 | A | 9/1997 | Maruta et al. |
| 5,678,125 | A | 10/1997 | Kutsuwada et al. |
| 5,758,235 | A | 5/1998 | Kosuge et al. |

(Continued)

FOREIGN PATENT DOCUMENTS

| | | |
|---|---|---|
| EP | 0 468 489 | 1/1992 |

(Continued)

OTHER PUBLICATIONS

U.S. Appl. No. 11/226,197, filed Sep. 15, 2005, Kimura et al.

(Continued)

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

An image forming apparatus includes a process cartridge, a toner storage, and a toner supplying unit. The process cartridge includes an image bearing member, a developer container, a developer bearing member, and a pair of side plates. The developer container includes a toner inlet mounted at a predetermined position on one of its top surface. The pair of side plates are arranged in parallel and separated by a predetermined distance which determines a predetermined longitudinal width of the process cartridge and configured to support the components in the process cartridge.

43 Claims, 16 Drawing Sheets

U.S. PATENT DOCUMENTS

| | | | |
|---|---|---|---|
| 5,758,241 | A | 5/1998 | Oyama et al. |
| 5,761,576 | A | 6/1998 | Sugihara et al. |
| 5,765,059 | A | 6/1998 | Kosuge et al. |
| 5,768,664 | A | 6/1998 | Kosuge et al. |
| 5,771,426 | A | 6/1998 | Oka et al. |
| 5,771,429 | A | 6/1998 | Oyama et al. |
| 5,784,669 | A | 7/1998 | Miura et al. |
| 5,787,328 | A | 7/1998 | Sugihara et al. |
| 5,805,965 | A | 9/1998 | Tsuda et al. |
| 5,815,767 | A | 9/1998 | Kutsuwada et al. |
| 5,822,664 | A | 10/1998 | Oka et al. |
| 5,826,146 | A | 10/1998 | Maruta et al. |
| 5,850,586 | A | 12/1998 | Sugihara et al. |
| 5,887,224 | A | 3/1999 | Mizuishi et al. |
| 5,913,092 | A | 6/1999 | Bisaiji et al. |
| 5,915,143 | A | 6/1999 | Watanabe et al. |
| 5,915,155 | A | 6/1999 | Shoji et al. |
| 5,915,156 | A | 6/1999 | Kizaki et al. |
| 5,940,664 | A | 8/1999 | Sugihara et al. |
| 5,956,549 | A | 9/1999 | Sugihara et al. |
| 5,991,569 | A | 11/1999 | Sugihara et al. |
| 5,999,772 | A | 12/1999 | Kakitani et al. |
| 6,006,050 | A | 12/1999 | Watanabe et al. |
| 6,026,255 | A | 2/2000 | Kizaki et al. |
| 6,055,388 | A | 4/2000 | Watanabe et al. |
| 6,055,394 | A | 4/2000 | Suda et al. |
| 6,070,037 | A | 5/2000 | Sugihara et al. |
| 6,072,967 | A | 6/2000 | Sugihara et al. |
| 6,097,914 | A | 8/2000 | Tanaka et al. |
| 6,101,351 | A | 8/2000 | Suda et al. |
| 6,104,900 | A | 8/2000 | Ishikawa et al. |
| 6,122,469 | A | 9/2000 | Miura et al. |
| 6,125,243 | A | 9/2000 | Shoji et al. |
| 6,141,520 | A | 10/2000 | Kosuge |
| 6,198,895 | B1 | 3/2001 | Tsuda et al. |
| 6,256,459 | B1 | 7/2001 | Hasegawa et al. |
| 6,256,465 | B1 | 7/2001 | Yoshinaga et al. |
| 6,336,013 | B1 | 1/2002 | Suda et al. |
| 6,336,020 | B1 | 1/2002 | Ishikawa et al. |
| 6,337,957 | B1 | 1/2002 | Tamaki et al. |
| 6,463,237 | B1 | 10/2002 | Suda et al. |
| 6,496,664 | B1 | 12/2002 | Ogata et al. |
| 6,522,855 | B1 | 2/2003 | Katoh et al. |
| 6,560,414 | B1 | 5/2003 | Suda et al. |
| 6,597,881 | B1 | 7/2003 | Hatori et al. |
| 6,601,991 | B1 | 8/2003 | Sampe |
| 6,615,013 | B1 | 9/2003 | Arai et al. |
| 6,763,208 | B1 | 7/2004 | Nagatsuna et al. |

FOREIGN PATENT DOCUMENTS

| | | | |
|---|---|---|---|
| EP | 1 041 452 | | 10/2000 |
| JP | 9-34230 | | 2/1997 |
| JP | 10-239974 | | 9/1998 |
| JP | 11-231631 | | 8/1999 |
| JP | 2002341648 A | * | 11/2002 |

OTHER PUBLICATIONS

U.S. Appl. No. 11/269,717, filed Nov. 9, 2005, Fujimori et al.
U.S. Appl. No. 11/203,964, filed Aug. 16, 2005, Taguchi et al.
U.S. Appl. No. 11/247,269, filed Oct. 12, 2005, Uchiyama et al.

* cited by examiner

METHOD AND APPARATUS OF IMAGE FORMING AND PROCESS CARTRIDGE INCLUDED IN THE APPARATUS

CROSS REFERENCE TO RELATED APPLICATIONS

The present application claims priority under 35 U.S.C. § 119 to Japanese Patent Application No. 2003-059126 filed on Mar. 5, 2003 in the Japanese Patent Office, the entire contents of which are incorporated herein by reference.

BACKGROUND OF THE INVENTION

1. Field of the Invention

The present invention relates to an image forming apparatus such as a copying machine, a facsimile machine, a printing machine and the like and a process cartridge detachably mounted to the image forming apparatus. More particularly, the present invention relates to an image forming apparatus including a process cartridge having a developing unit and other image forming components, and a reservoir containing toner to be supplied to the developing unit and to the process cartridge itself.

2. Discussion of the Background

A background image forming apparatus includes a detachable process cartridge in which consumable components, such as a developing unit including a developer bearing member and a developer container, an image bearing member, an electric charging unit, a cleaning unit and the like are integrally mounted. When the developer container is empty of toner, the process cartridge is replaced by a new process cartridge, allowing a user to replenish toner and exchange the consumable components at one time. Such a cartridge replacement operation is simpler than others where the replenishment of toner and the exchange of the consumable components are separately performed.

However, when image forming processes repeatedly involve print jobs of images having a large area coverage, a large amount of toner is consumed in a relatively small number of printouts. In these cases, the process cartridge runs out of toner and must be replaced before the other consumable components reach the end of their useful life.

To avoid the above-described waste, a technique has been proposed such that a toner bottle is detachably arranged in the process cartridge to separately replenish the toner from the toner bottle to the developing unit. However, when the toner bottle is replaced, the user firstly needs to remove the process cartridge out of the image forming apparatus before removing the toner bottle from the process cartridge. This makes the toner replenishment process long and complicated.

Another easier technique used in background image forming apparatuses for replacing a toner bottle includes providing the process cartridge and the toner separate from each other and detachably arranged therein. However, since the process cartridge needs to be arranged in the vicinity of the toner bottle, the process cartridge and the toner bottle cannot be flexibly arranged in the image forming apparatus. A flexibility in positioning the process cartridge and the toner bottle is required in order to better utilize space in the image forming apparatus and to allow an overall size reduction, particularly, in full-color image forming apparatuses referring four or more sets of toner bottles and process cartridges. Therefore, the flexibility of positioning toner bottles and process cartridges needs to be increased.

Another technique proposed for improving the background image forming apparatus is to arrange the toner bottle away from the process cartridge and to provide a toner supplying unit for supplying the toner in the toner bottle to a developer container in the process cartridge. This increases the flexibility of positioning the process cartridge and the toner bottle in the background image forming apparatus. However, when the toner bottle is arranged away from the process cartridge, the image forming apparatus is made larger because of additional structure needed to support a toner supplying portion.

Referring to FIG. 1, operations of a background process cartridge 1 are described. This process cartridge 1 is one of a plurality of process cartridges for a background color image forming apparatus (not shown). The plurality of process cartridges have identical structures. Therefore, an explanation will be given focusing on the operations performed by the process cartridge 1.

The process cartridge 1 includes an image bearing member 2 and image forming components, such as a charging unit 3, a developing unit 4 and a drum cleaning unit 5. The developing unit 4 includes a developing sleeve 6 and a developer container 7 having a first developer agitating member 7*a* and a second developer agitating member 7*b*.

The image bearing member 2 is a drum-shaped photoconductive element which forms an electrostatic latent image for a single color toner image on its surface. The image forming components are arranged around the image bearing member 2 and form the single color toner image based on the electrostatic latent image formed on the image bearing member 2. When toner of a predetermined color is supplied to the developer container 7, the first and second developer agitating members 7*a* and 7*b* agitate the toner and the first developer agitating member 7*a* conveys the toner toward a surface of the developing sleeve 6. Concurrently with the operation of transferring the toner to the developing sleeve 6, the image bearing member 2 rotating counterclockwise is charged by the charging unit 3 and irradiated by a laser beam L emitted from an optical writing unit (not shown) so that an electrostatic latent image is formed on a surface of the image bearing member 2. The toner held on the surface of the developing sleeve 6 is transferred to the surface of the image bearing member 2 at a nip portion formed between the developing sleeve 6 and the image bearing member 2, and the single color toner image is formed on the surface of the image bearing member 2. Then, the toner image is transferred onto a transfer medium. Residual toner adhering on the surface of the image bearing member 2 is removed by the drum cleaning unit 5.

As shown in FIG. 1, the laser beam L emitted by the optical writing unit arranged below the process cartridge 1 has to travel over the developer container 7. In a background printer including a process cartridge having such a structure, a toner supplying unit (not shown) has to be provided at a portion where it does not block the laser beam L; therefore, possible locations for the toner supplying unit are limited.

Generally, an open/close mechanism is provided to an engaging portion of the process cartridge 1 and the toner supplying unit and a predetermined space is required to mount members for the engaging portion. Moreover, the toner moves by gravity from the toner supplying unit to the process cartridge 1. However, if the toner supplying unit is arranged to a portion higher than the process cartridge 1, a part of the toner supplying unit occupies a space over the developer container 7, which may result in a blockage of the laser beam L.

In order to avoid the inconvenience of the location of the toner supplying unit, it is proposed that the toner supplying unit be provided next to the developer container 7 of the process cartridge 1.

Referring to FIG. 2, a toner supplying portion 8 provided to the background process cartridge 1 of FIG. 1 is described. The process cartridge 1 further includes the toner supplying portion 8. The toner supplying portion 8 includes a toner conveying shaft 9 having a mylar 9*a* at an end portion thereof. The toner supplying portion 8 receives the toner supplied from a toner bottle (not shown). The toner conveying shaft 9 is rotated so that the mylar 9*a* agitates and conveys the toner toward the developer container 7. Namely, the toner in the toner bottle is supplied to the developer container 7 not directly but via the toner supplying portion 8. As shown in FIG. 2, the toner supplying portion 8 needs to be provided in addition to the developer container 7, making the size of the process cartridge 1, and consequently the size of the image forming apparatus also larger.

As described above, in order to increase the flexibility in locating a process cartridge and a toner bottle in an image forming apparatus, it is required to locate the toner bottle at a portion away from the process cartridge, thereby allowing the overall size of the image forming apparatus to be minimized.

SUMMARY OF THE INVENTION

The present invention has been made in view of the above circumstances. It is one of the objects of the present invention to provide a novel image forming apparatus that eliminates the above-described condition.

It is another object of the present invention to provide a novel process cartridge included in the novel image forming apparatus.

In one exemplary embodiment, a novel image forming apparatus includes a process cartridge, a toner storage and a toner supplying unit. The process cartridge further includes an image bearing member, a developer container, a developer bearing member, and a pair of side plates. The image bearing member is configured to form an electrostatic latent image in an image forming area on a surface thereof. The developer container contains a developer, including toner and carriers, and includes a toner inlet mounted at a predetermined position on a top surface thereof. The developer bearing member is arranged in a vicinity of and in parallel with the image bearing member and is configured to carry the developer to a toner image developing area formed between the image bearing member and the developer bearing member. The pair of side plates are arranged parallel to each other with a predetermined distance which defines a predetermined longitudinal width of the process cartridge and are configured to support the image bearing member, the developer container, and the developer bearing member. The toner supplying unit is configured to convey the toner from the detachable toner storage to the developer container through the toner inlet.

The predetermined position for the toner inlet may be located within the predetermined longitudinal width between the pair of side plates.

The predetermined position for the toner inlet may be located within an area of the predetermined longitudinal width between the pair of side plates corresponding to the electrostatic latent image forming area of the image bearing member.

The predetermined position for the toner inlet may be located within an area of the predetermined longitudinal width between the pair of side plates corresponding to the toner image developing area formed between the image bearing member and the developer bearing member.

The above-described image forming apparatus may further include a latent image forming unit configured to emit a laser beam for irradiating the surface of the image bearing member, and arranged at a position to avoid obstructing the laser beam.

The predetermined position for the toner inlet may be below a top surface of the developer bearing member.

The toner supplying unit may include a tubular engager and a toner outlet. The tubular engager is mounted to a lower-end portion of the toner supplying unit and is configured to slide in a direction parallel to a direction in which the process cartridge is inserted to engage the toner supplying unit with the process cartridge as the process cartridge is inserted. The toner outlet is arranged at a position in the lower-end portion of the toner supplying unit to face the toner inlet of the developer container of the process cartridge for supplying the toner conveyed through the toner supplying unit.

The toner supplying unit may further include a toner outlet shutter and a pressing member. The toner outlet shutter is movably mounted to the lower-end portion of the toner supplying unit and is configured to open and close the toner outlet. The pressing member is configured to push the toner outlet shutter for closing the toner outlet when the process cartridge is removed and to be pressed by the toner outlet shutter for opening the toner outlet when the process cartridge is installed.

The developer container of the process cartridge may further include a toner inlet shutter and a pressing member. The toner inlet shutter is arranged on the top surface of the process cartridge and is configured to open and close the toner inlet. The pressing member is configured to push the toner inlet shutter for closing the toner inlet when the process cartridge is removed and to be pressed by the toner inlet shutter for opening the toner inlet when the process cartridge is installed.

The developer container may include a plurality of toner conveying screwed shafts arranged in parallel to each other and configured to agitate and convey the developer accommodated in the developer container, and the predetermined position for the toner inlet is arranged on a top of one of the plurality of toner conveying screwed shafts not immediately next to the developer bearing member.

The developer container of the process cartridge may further include at least one separating member, each of which is arranged at a center between two neighboring toner conveying screwed shafts among the plurality of toner conveying screwed shafts and is configured to separate a space between the two neighboring toner conveying screwed shafts except for end sides of the two neighboring toner conveying screwed shafts into two oppositely-directed developer conveying paths. And the predetermined position of the toner inlet is located on one of the at least one separating member associated with one of the plurality of toner conveying screwed shafts not immediately next to the developer bearing member.

Further, in one exemplary embodiment, a novel method of manufacturing an image forming apparatus may include the steps of providing a housing of a process cartridge to the image forming apparatus, placing a pair of side plates arranged parallel to each other with a predetermined distance which determines a predetermined longitudinal width of the process cartridge and configured to support the image bearing member, the developer container, and the developer bearing member, locating an image bearing member in the process cartridge, the image bearing member being configured to form an electrostatic latent image in an electrostatic latent image forming area on a surface thereof, locating a developer container in a vicinity of the image bearing member in parallel, the developer container contains a developer, including toner and carriers, and a toner inlet mounted at a predetermined position on a top surface of the developer container, placing a developer bearing member arranged in a vicinity of and in parallel with the image bearing member and configured to carry the developer to a toner image developing area formed between the image bearing member and the developer bearing member, installing a toner storage, and providing a toner supplying unit between the detachable toner storage and the developer container to convey toner from the toner storage to the developer container through the toner inlet.

The above-described method may further include the step of placing a latent image forming unit arranged at a position to avoid obstructing the laser beam, the latent image forming unit being configured to emit a laser beam for irradiating the surface of the image bearing member.

The above-described method of manufacturing an image forming apparatus may further include the steps of mounting a tubular engager to a lower-end portion of the toner supplying unit configured to slide in a direction parallel to a direction in which the process cartridge is inserted to engage the toner supplying unit with the process cartridge, and applying a toner outlet arranged at a position in the lower-end portion of the toner supplying unit to face the toner inlet of the developer container of the process cartridge for supplying the toner conveyed through the toner supplying unit.

The above-described method of manufacturing an image forming apparatus may further include the steps of mounting a toner outlet shutter to the lower-end portion of the toner supplying unit to open and close the toner outlet, and applying a pressing member configured to push the toner outlet shutter to close the toner outlet when the process cartridge is removed and to open the toner outlet when the process cartridge is installed.

The above-described method of manufacturing an image forming apparatus may further include the steps of mounting a toner inlet shutter arranged on the top surface of the process cartridge and configured to open and close the toner inlet and applying a pressing member configured to push the toner inlet shutter to close the toner inlet when the process cartridge is removed and to be pressed by the toner inlet shutter to open the toner inlet when the process cartridge is installed.

The above-described method of manufacturing an image forming apparatus may further include the steps of providing a plurality of toner conveying screwed shafts arranged in parallel to each other and configured to agitate and convey the developer in the developer container, wherein the predetermined position for the toner inlet is arranged on a top of one of the plurality of toner conveying screwed shafts not immediately next to the developer bearing member.

The above-described method of manufacturing an image forming apparatus may further include the steps of providing at least one separating member, each being arranged at a center between two neighboring toner conveying screwed shafts among the plurality of toner conveying screwed shafts and configured to separate a space between the two neighboring toner conveying screwed shafts except for end sides of the two neighboring toner conveying screwed shafts into two oppositely directed developer conveying paths, and the predetermined position of the toner inlet locates on one of the at least one separating member associated with one of the plurality of toner conveying screwed shafts not immediately next to the developer bearing member.

Further, in one exemplary embodiment, a novel process cartridge may include an image bearing member, a developer container, a developer bearing member, and a pair of side plates. The image bearing member is configured to form an electrostatic latent image on a surface of an electrostatic latent image forming device. The developer container contains a developer, including toner and carriers, and includes a toner inlet mounted at a predetermined position on a top surface of the developer container. The developer bearing member is arranged in a vicinity of and in parallel with the image bearing member and is configured to carry the developer to a toner image developing area formed between the image bearing member and the developer bearing member. The pair of side plates are arranged parallel to each other with a predetermined distance defining a longitudinal width of the process cartridge to support the image bearing member, the developer container, and the developer bearing member. The process cartridge is detachably provided to an image forming apparatus which includes a toner storage and a toner supplying unit to convey toner from the toner storage to the developer container through the toner inlet.

Further, in one exemplary embodiment, a novel method of manufacturing a process cartridge includes the steps of placing a pair of side plates, arranged parallel to each other with a predetermined distance to define a predetermined longitudinal width of the process cartridge, to support the image bearing member, the developer container, and the developer bearing member, locating an image bearing member in the process cartridge, the image bearing member being configured to form an electrostatic latent image on an area a surface of an electrostatic latent image forming device, locating a developer container in the vicinity of and parallel to the image bearing member, the developer container containing a developer, including toner and carriers, and a toner inlet, mounted at a predetermined position on a top surface of the developer container, to receive toner into the developer container, and placing a developer bearing member arranged in a vicinity of and in parallel with the image bearing member to carry the developer to a toner image developing area formed between the image bearing member and the developer bearing member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
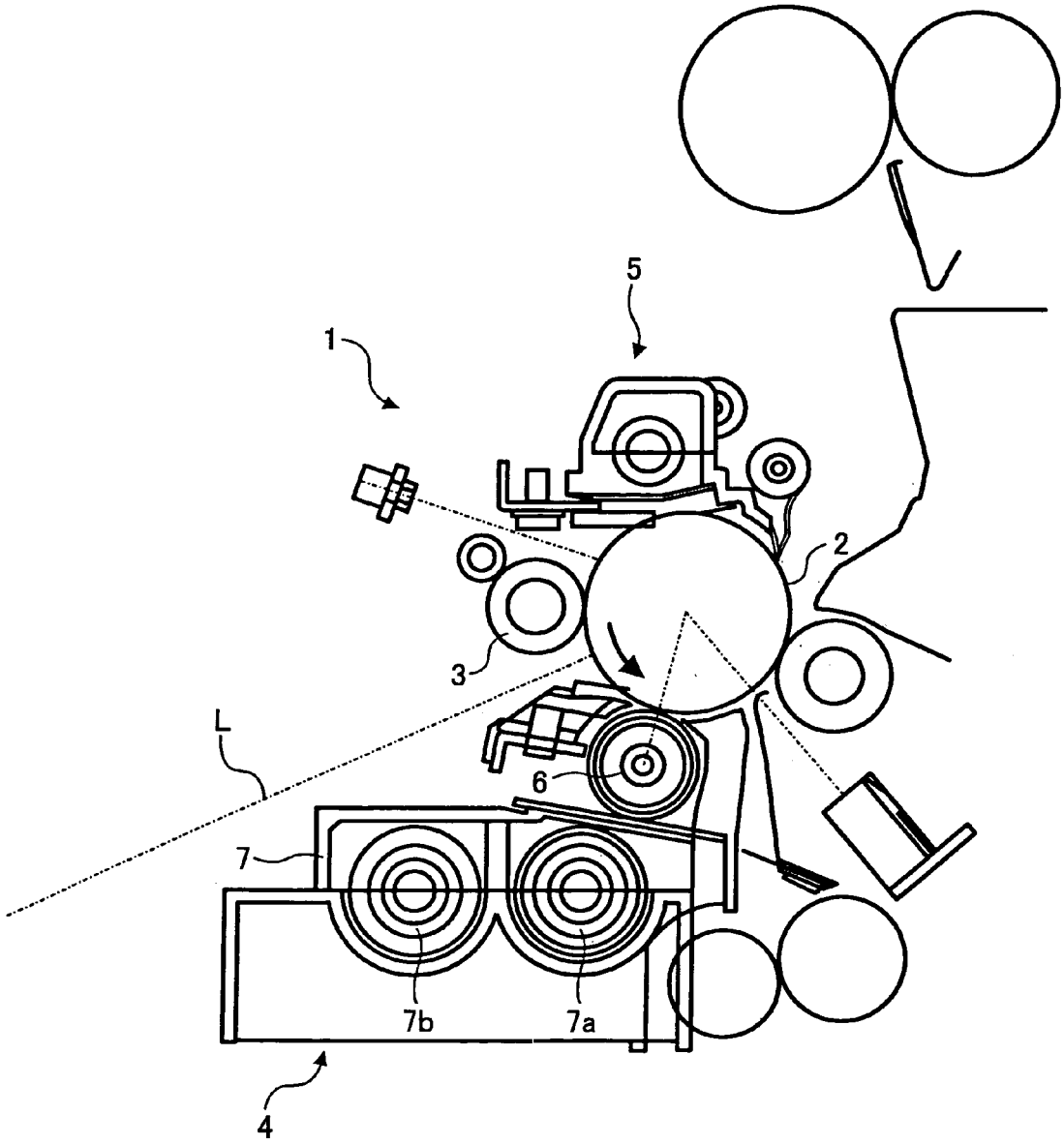
FIG. 1 PRIOR ART
FIG. 1 is a drawing of a structure of a background process cartridge and a path of a laser beam L.
Figure 2:
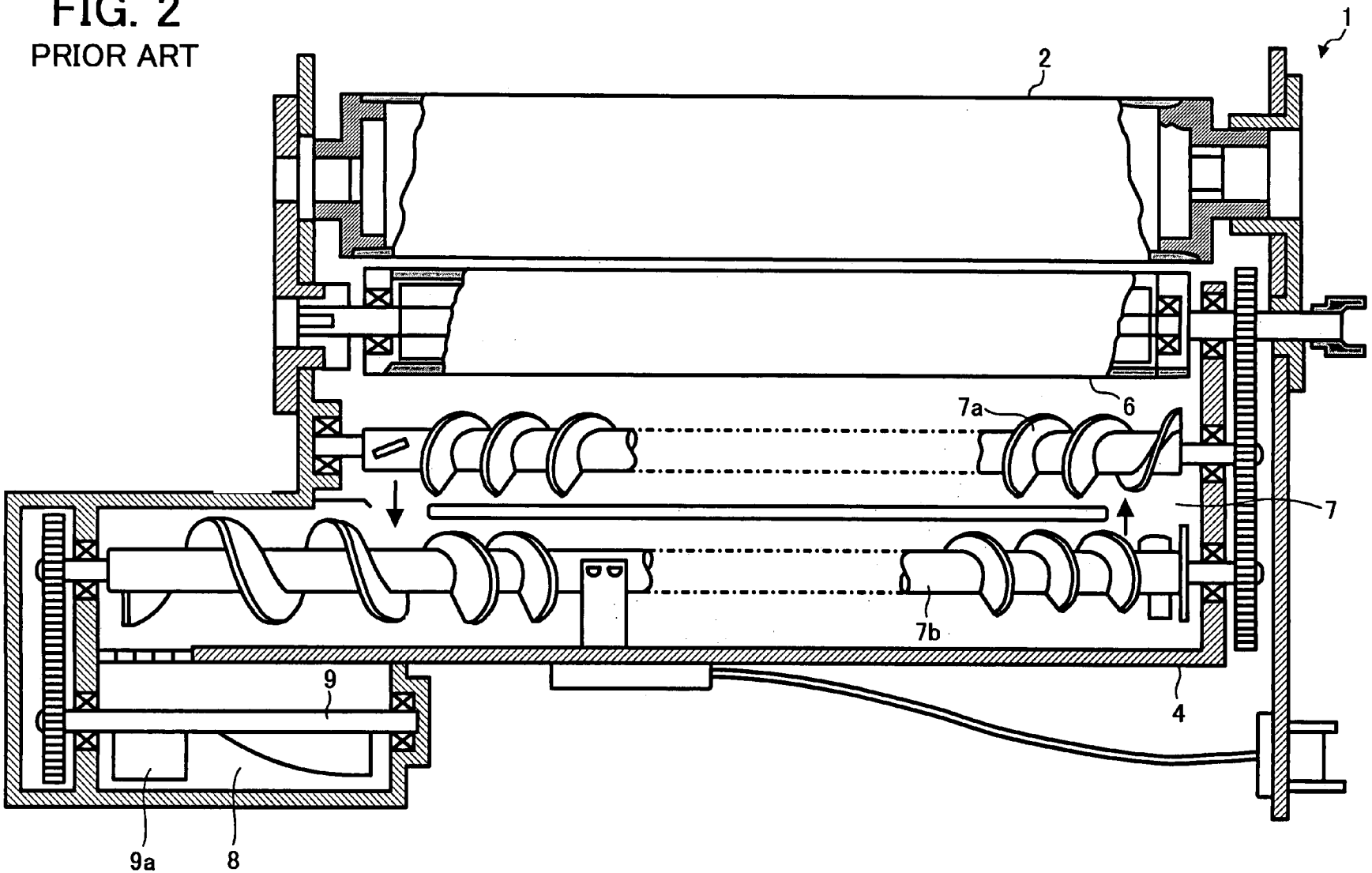
FIG. 2 PRIOR ART
FIG. 2 is a drawing of another background process cartridge having a toner supplying portion mounted thereon.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 3:
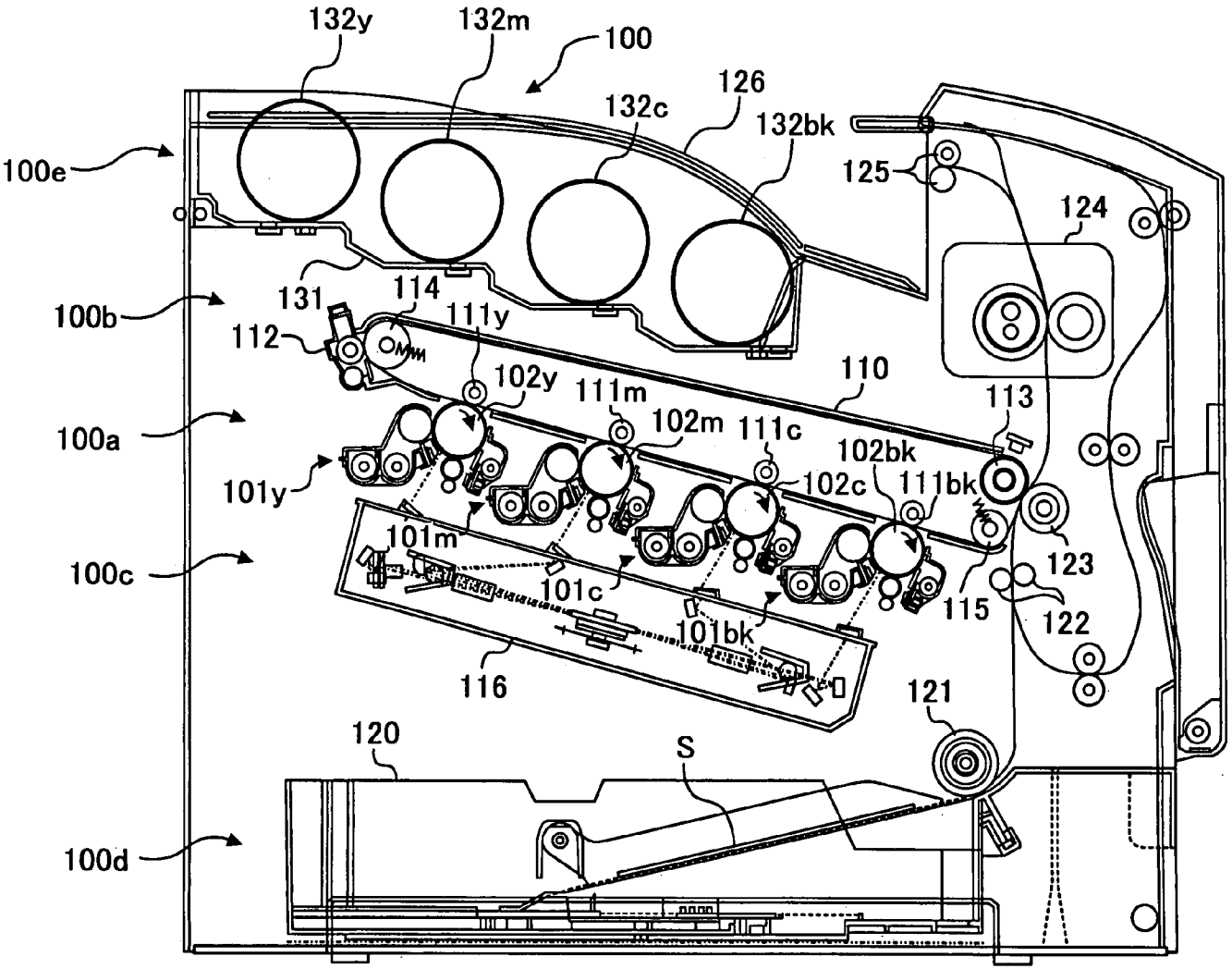
FIG. 3 is a drawing of a structure of a color printer according to an exemplary embodiment of the present invention.
Figure 4:
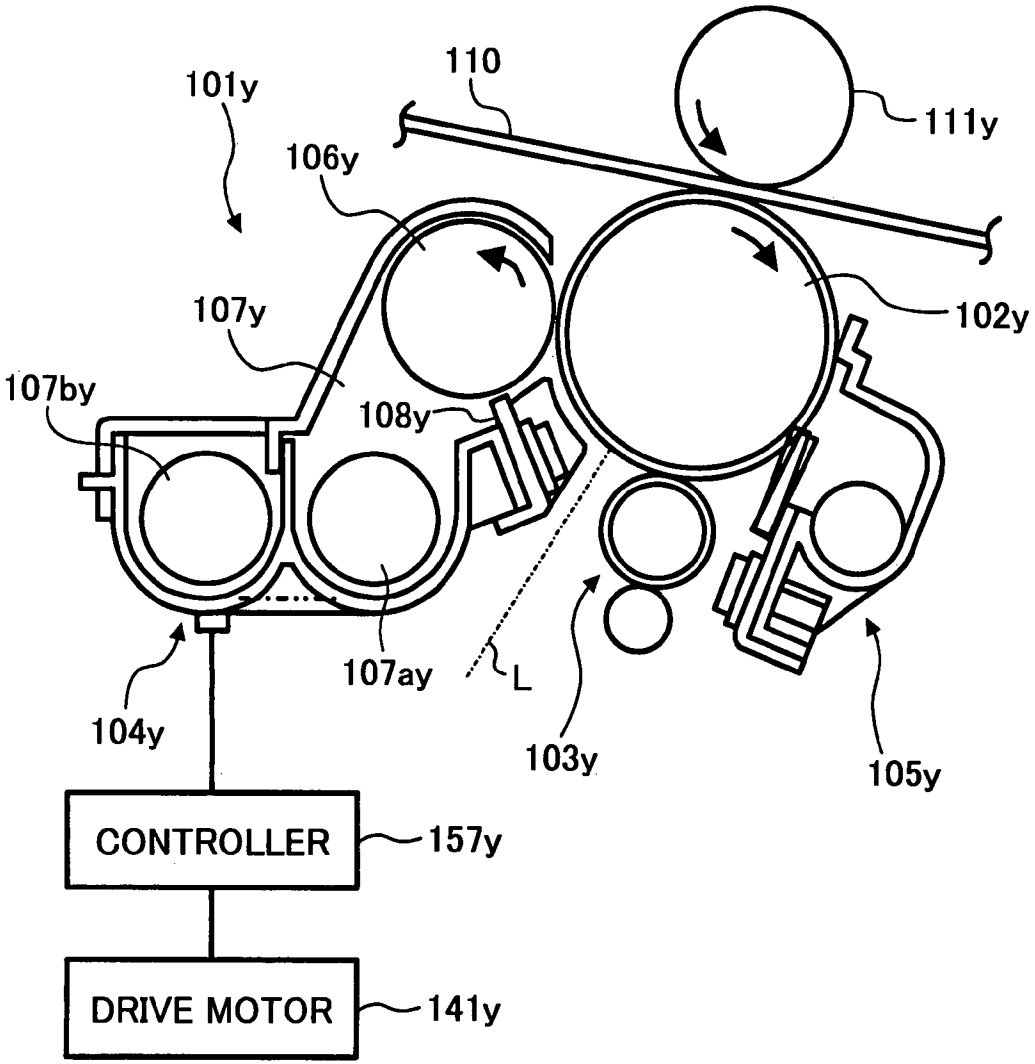
FIG. 4 is a drawing of a structure of a novel process cartridge included in the color printer of FIG. 3 and a path of a laser beam L.

Referring now to the drawings, wherein like reference numerals designate identical or corresponding parts throughout the several views, particularly to FIGS. 3 and 4, a color printer 100 as shown as one example of an electrophotographic image forming apparatus according to an exemplary embodiment of the present invention.

In FIG. 3, the color printer 100 includes an image forming mechanism 100*a*, an intermediate transfer system 100*b*, an optical writing system 100*c*, a sheet handling mechanism 100*d*, and a toner feeding mechanism 100*e*.

The image forming mechanism 100*a* includes four process cartridges 101*y*, 101*c*, 101*m*, and 101*bk* for forming yellow (y), cyan (c), magenta (m), and black (bk) toner images, respectively, of toner accommodated in the respective process cartridges 101*y*, 101*c*, 101*m* and 101*bk*. Each of these process cartridges may be separately replaced at the end of its useful life. FIG. 4 illustrates an enlarged sectional view of the process cartridge 101*y*. Since process cartridges 101*y*, 101*c*, 101*m* and 101*bk* have identical structures and functions, except to the fact the toners are of different colors, FIG. 4 illustrates only the process cartridge 101*y*.

In FIG. 4, the process cartridge 101*y* includes an image bearing member 102*y* and consumable components, such as a discharging unit (not shown), a charging unit 103*y*, a developing unit 104*y*, and a drum cleaning unit 105*y*. The process cartridge 101*y* communicates with a controller 157*y* and a drive motor 141*y*. The developing unit 104*y* includes a developing sleeve 106*y*, a developer container 107*y*, a first toner conveying screwed shaft 107*ay*, a second toner conveying screwed shaft 107*by*, and a doctor 108*y*. The process cartridge 101*y* is detachably provided to the color printer 100 so that the consumable components may be replaced when needed.

The intermediate transfer system 100*b* is arranged above the image forming mechanism 100*a* and includes an intermediate transfer belt 110, primary bias rollers 111*y*, 111*c*, 111*m*, and 111*bk*, and a belt cleaning unit 112. The intermediate transfer belt 110 is supported by a secondary transfer backup roller 113, a belt cleaning backup roller 114, and a tension roller 115, and is held in contact with the primary bias rollers 111*y*, 111*c*, 111*m*, and 111*bk* corresponding to process cartridges 101*y*, 101*c*, 101*m*, and 101*bk*, respectively. The belt cleaning unit 112 is disposed in contact with the belt cleaning backup roller 114.

The optical writing system 100*c* is arranged below the image forming mechanism 100*a* and includes an optical writing unit 116.

The sheet handling mechanism 100*d* includes a sheet feeding cassette 120, a sheet feeding roller 121, a registration roller pair 122, a secondary transfer roller 123, a fixing unit 124, a sheet discharging roller pair 125, and a sheet discharging part 126.

Figure 5:
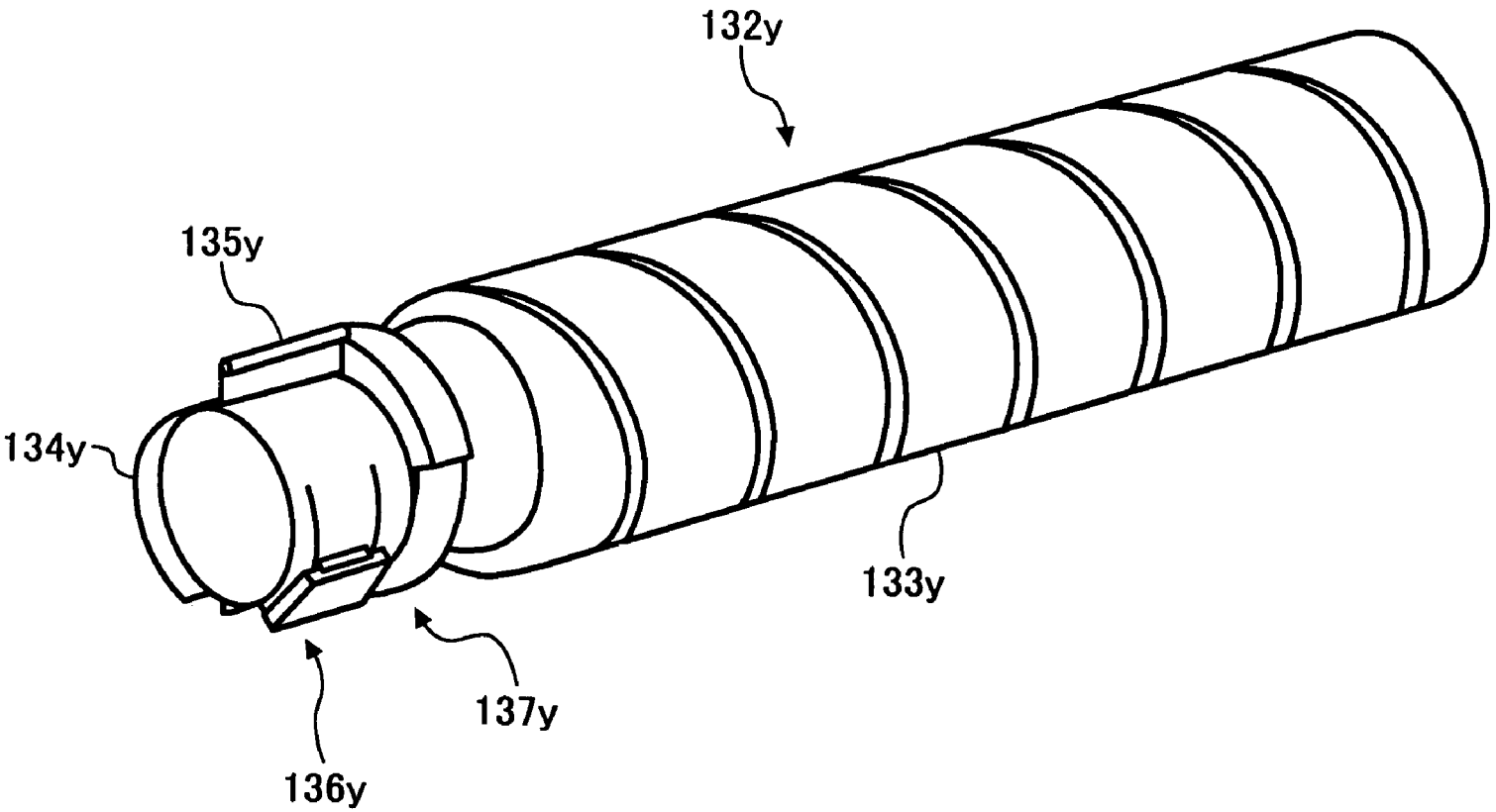
FIG. 5 is a drawing of a toner bottle provided to the color printer of FIG. 3.
Figure 7:
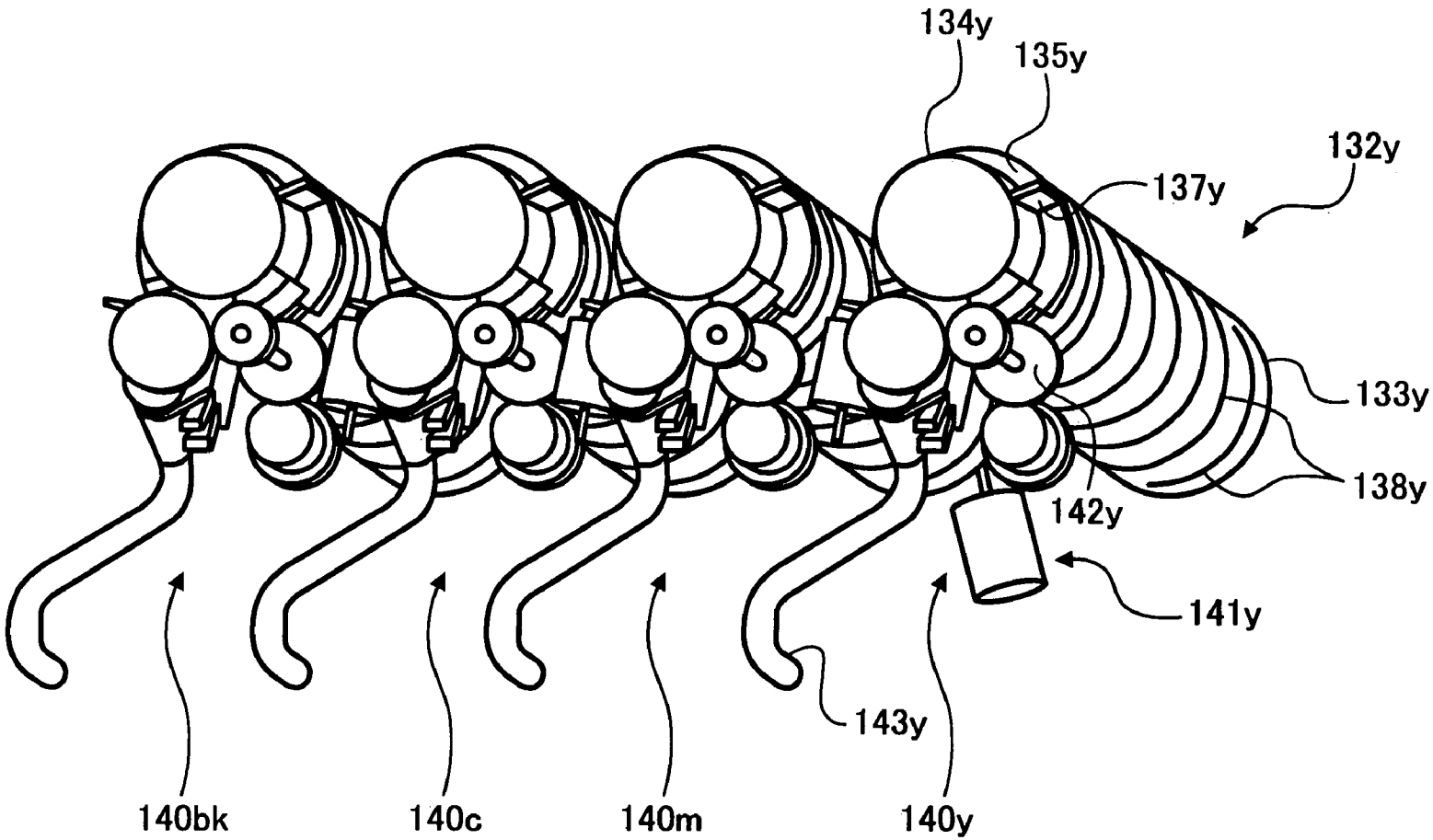
FIG. 7 is a drawing of the four toner bottles engaged with respective toner supplying units.

The toner feeding mechanism 100*e* is arranged above the intermediate transfer system 100*b* and includes a toner bottle holder 131 and a plurality of toner bottles 132*y*, 132*c*, 132*m*, and 132*bk*. FIG. 5 illustrates a toner bottle 132*y*. Since the plurality of toner bottles 132*y*, 132*c*, 132*m*, and 132*bk* have identical structures, FIG. 5 illustrates only the structure of the toner bottle 132*y*. In FIG. 5, the toner bottle 132*y* includes a bottle body 133*y*, a bottle cap 134*y*, a handle 135*y*, a toner stopper 136*y*, and a bottle gear 137*y*. The toner bottle 132*y* is detachably arranged to the toner bottle holder 131 as illustrated in FIG. 7.

The color printer 100 produces a full-color image through the following operations. The optical writing system 100*c* emits laser beams to the image forming mechanism 100*a*. The image forming mechanism 100*a* produces different color images with toners conveyed by the toner feeding mechanism 100*e* and transfers the images one after another onto the intermediate transfer system 100*b* to form an overlaid full-color image, which is subsequently transferred onto a transfer sheet fed by the sheet handling mechanism 100*d*. The full-color image transferred onto the transfer sheet is then fixed and discharged onto the top of the color printer 100.

More specifically, the operations for producing the full-color image are described below. The optical writing unit 116 emits a laser beam L according to image data. The optical writing unit 116 employs a polygon mirror driven by a motor to deflect the laser beam L to irradiate a surface of the image bearing member 102*y* of the process cartridge 101*y* via a plurality of optical lenses and mirrors so that an electrostatic latent image is formed.

Referring now to FIG. 4, operations of the image forming mechanism 100*a* are described. As previously described, the process cartridges 101*y*, 101*c*, 101*m*, and 101*bk* have identical structures. Therefore, the explanation given will focus only on the operations performed by the process cartridge 101*y*.

Image forming components, such as the charging unit 103*y*, the developing unit 104*y*, the drum cleaning unit 105*y*, are arranged around the image bearing member 102*y* and form a single color toner image based on the electrostatic latent image formed on the image bearing member 102*y*.

The image bearing member 102*y* is rotated clockwise by a drive unit (not shown).

The charging unit 103*y* is applied with a charged voltage, uniformly charging the image bearing member 102*y* to a predetermined polarity.

The developing unit 104*y* thus visualizes the electrostatic latent image as a yellow toner image. The developing sleeve 106*y* is rotatably arranged in the developing unit 104*y* and is closely placed opposite to the image bearing member 102*y* through an open space formed on the developing unit 104*y*. The developing sleeve 106*y* is a developer bearing member and includes a magnetic field generator so that it can hold two-component toner on its surface, including magnetic particles and toner. The doctor 108*y* is a developer regulating member for regulating a toner layer to a predetermined height positioned in a vicinity of the developing sleeve 106*y*. As illustrated in FIG. 4, the developer container 107*y* is positioned before the doctor 108*y* and holds developer prevented by the doctor 108*y* from being conveyed to the developing area, which is a nip portion formed between the developing sleeve 106*y* and the image bearing member 102*y*. The function of the first and second toner conveying screwed shafts 107*ay* and 107*by* is to agitate the toner.

Toner is supplied to the developing container 107*y* so that a toner density is kept within a predetermined range. The developing unit 104*y* includes a toner density sensor (not shown) for detecting the toner density in the developer container 107*y* and reporting it to a controller 157*y*. Upon receiving a detection result that the toner density is not in the predetermined range, the controller 157*y* issues a toner supply request signal to a drive motor 141*y* to control the toner density. The toner supplied into the developer container 107*y* is rubbed with a carrier and is frictionally charged. The developer, including the frictionally charged toner having a polarity, is conveyed to the surface of the developing sleeve 106*y* and held thereon by a magnetic force generated in the developing sleeve 106*y*. The developer held on the surface of the developing sleeve 106*y* is then conveyed in the direction of rotation of the developing sleeve 106*y* as indicated in FIG. 4. The developer is regulated to a predetermined height by the doctor 108*y* before being conveyed to the nip portion. Then, the developer is transferred onto a surface of the image bearing member 102*y*. The developer remained on the surface of the developing sleeve 106*y* is conveyed toward an upper portion of the developing sleeve 106*y* in a developer conveying direction.

The drum cleaning device 105*y* removes residual toner adhering to the surface of the image bearing member 102*y* and then the discharging device 103*y* removes residual charges on the image bearing member 102*y*. After the discharging operation, the image bearing member 102*y* is ready for the next image forming operation.

In FIG. 3, the intermediate transfer belt 110 forms an endless belt extended with pressure around the secondary transfer backup roller 113, the belt cleaning backup roller 114, and the tension roller 115, rotating counterclockwise by a motor (not shown) The intermediate transfer belt 110 is held in contact to form a primary transfer nip between the image bearing member 102*y* and the primary bias roller 111*y*. The primary bias roller 111*y* is arranged at a position opposite to the image bearing member 102*y* such that the toner image formed on the surface of the image bearing member 102*y* is transferred onto the intermediate transfer belt 110. The primary bias roller 111*y* receives a transfer voltage having a polarity opposite to the charged toner so as to transfer it to the inside surface of the intermediate transfer belt 110, transferring the yellow toner image onto the surface of the intermediate transfer belt 110. A cyan toner image, a magenta toner image, and a black toner image are sequentially overlaid on the surface of the intermediate transfer belt 110 on which the yellow toner image is already formed, such that a primary overlaid toner image is formed on the intermediate transfer belt 110. Hereinafter, the primary overlaid toner image is referred to as a primary four-color toner image. After the toner images in different colors are sequentially transferred on the intermediate transfer belt 110, residual toners on the process cartridges 101*y*, 101*c*, 101*m*, and 101*bk* are removed by the belt cleaning device 112.

In FIG. 3, the sheet feeding cassette 120 accommodates a plurality of recording media such as transfer sheets that include a transfer sheet S. The sheet feeding roller 121 and the registration roller pair 122 form a sheet conveying portion. The sheet feeding roller 121 is held in contact with the transfer sheet S. When the sheet feeding roller 121 is rotated counterclockwise by a drive motor (not shown), the transfer sheet S placed on the top of a stack of transfer sheets in the sheet feeding cassette 120 is fed and is conveyed to a portion between rollers of the registration roller pair 122. The registration roller pair 122 stops and feeds the transfer sheet S in synchronization with a movement of the primary four-color toner image towards a secondary transfer area which is a secondary nip portion formed between the intermediate transfer belt 110 and the secondary transfer roller 123. The secondary transfer roller 123 is applied with an adequate predetermined transfer voltage such that the primary four-color image, formed on the surface of the intermediate transfer belt 110, is transferred on the transfer sheet S to form a secondary four-color image.

The transfer sheet S that has the secondary four-color image thereon is conveyed further upward and passes between a pair of fixing rollers of the fixing unit 124. The fixing unit 124 fixes the secondary four-color image to the transfer sheet S by applying heat and pressure. After the transfer sheet S passes the fixing unit 124, the transfer sheet S is discharged by the sheet discharging roller pair 125 to the sheet discharging part 126 provided at the upper portion of the color printer 100. The belt cleaning unit 112 removes residual toner adhering on the surface of the intermediate transfer belt 110.

Toner supplied from the toner feeding mechanism 100*e* is provided at an upper portion of the color printer 100 between the intermediate transfer system 100*b* and the sheet discharging part 126. The toner bottle holder 131 holds the plurality of toner bottles 132*y*, 132*c*, 132*m*, and 132*bk* for storing yellow, cyan, magenta and black toners, respectively. The yellow, cyan, magenta, and black toners are conveyed, via respective toner supplying units which will be further described below, to the respective process cartridges 101*y*, 101*c*, 101*m*, and 101*bk* according to a signal issued by the toner density sensor. The plurality of toner bottles 132*y*, 132*c*, 132*m*, and 132*bk* are separately provided with respect to the respective process cartridges 101*y*, 101*c*, 101*m*, and 101*bk* and detachably arranged to the color printer 100.

As shown in FIG. 3, the optical writing unit 116 is positioned at a location underneath the developer container 107*y* of the process cartridge 101*y*. Therefore, as shown in FIG. 4, the laser beam L does not pass over the process cartridge 101*y* and the developer container 107*y*. This prevents the toner supplying unit 140*y* (not shown) from blocking the laser beam L and also contributes to making the color printer 100 smaller in size. Thus, the present invention can provide a further compact printer.

Referring to FIG. 5, a structure of a yellow toner bottle 132*y* will now be described. A bottle cap 134*y* is a rotating member rotatably mounted to the bottle body 133*y* and configured to block toner from falling there from. A handle 135*y* is integrally mounted to the bottle cap 134*y* while a toner stopper 136*y* is slidably movable on the bottle cap 134*y*. A bottle gear 137*y* is provided in the vicinity of a portion for mounting the bottle cap 134*y* of the bottle body 133*y*. The bottle gear 137*y* is an input gear used as an input portion integrally mounted to the bottle body 133*y*. When the toner bottle 132*y* is mounted to the color printer 100, a user opens a portion where the sheet discharging part 126 of FIG. 3 is located, exposing a toner bottle holder 131.

Figure 6:
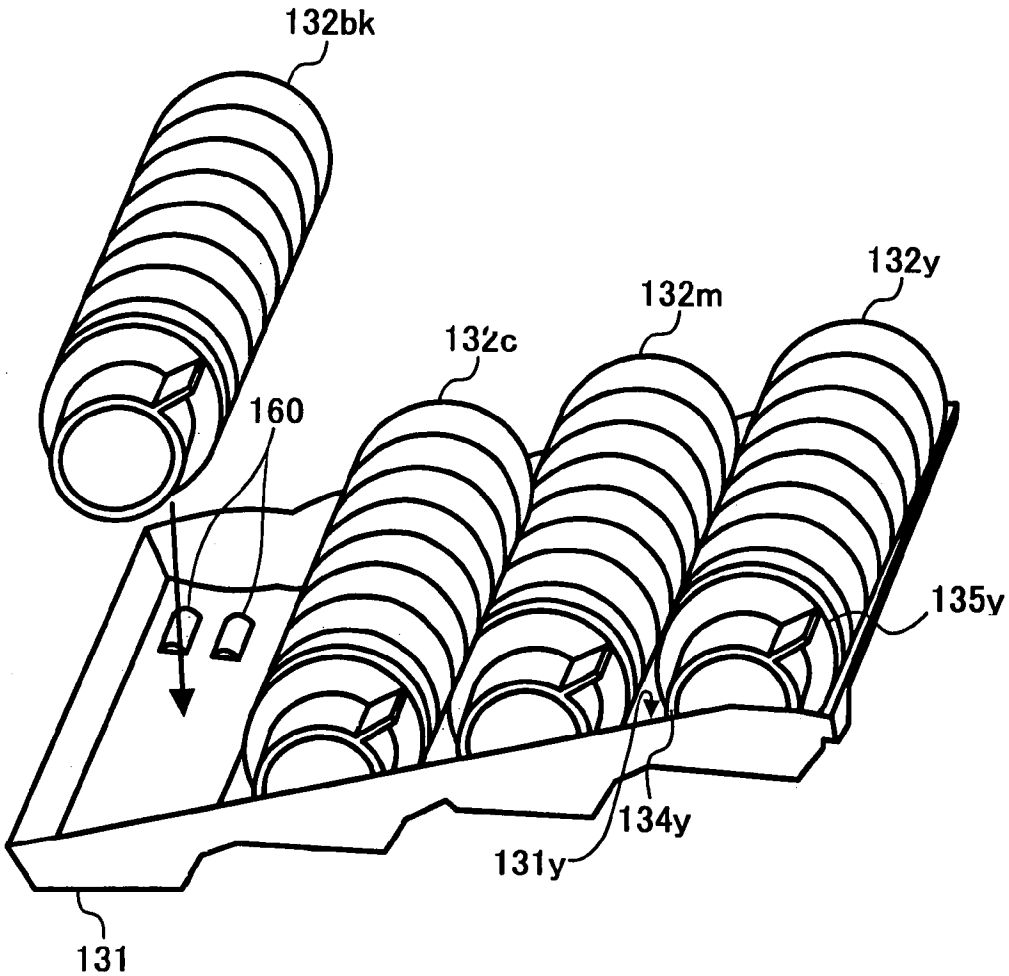
FIG. 6 is a drawing of four toner bottles mounted to a toner bottle holder provided to a toner supplying mechanism in the color printer of FIG. 3.

Referring to FIG. 6, the toner bottle holder 131, supporting the plurality of toner bottles 132*y*, 132*c*, 132*m*, and 132*bk*, will now be described.

The toner bottle holder 131 includes rollers 160 on an inner bottom surface in the vicinity of end portions of each section where the toner bottles 132*y*, 132*c*, 132*m*, and 132*bk* are disposed for reducing the rotational load of the toner bottles.

To mount the toner bottle 132*y* on the toner bottle holder 131, the user places the toner bottle 132*y* on the toner bottle holder 131 and turns the handle 135*y*, simultaneously turning the bottle cap 134*y* and slidably turning the toner stopper 136*y* in a direction of rotation of the bottle cap 134*y*. By such mounting process a toner exit is opened, and the bottle cap 134*y* is latched and fixedly connected to the toner bottle holder 131.

To remove the toner bottle 132*y* from toner bottle holder 131 in the color printer 100, the user reversely turns the handle 135*y* of the toner bottle 132*y* so that the bottle cap 134*y* is released from the toner bottle holder 131. At this time, the toner stopper 136*y* is closed and the toner exit is also closed. With the handle 135*y* held by the user, the toner bottle 132*y* can be removed from the color printer 100. With such an advantageous structure, the toner bottle 132*y* can be easily exchanged from the color printer 100. Further, the user can simply turn the handle 135*y* provided in the bottle cap 134*y* so that the toner bottle 132*y* can easily be fixed to the toner bottle holder 131. When the toner bottle 132*y* is not mounted to the color printer 100, the toner stopper 136*y* is closed even if the user tries to turn the handle 135*y*, thereby preventing toner from spilling even during the exchange of the toner bottle 132*y*.

Figure 8:
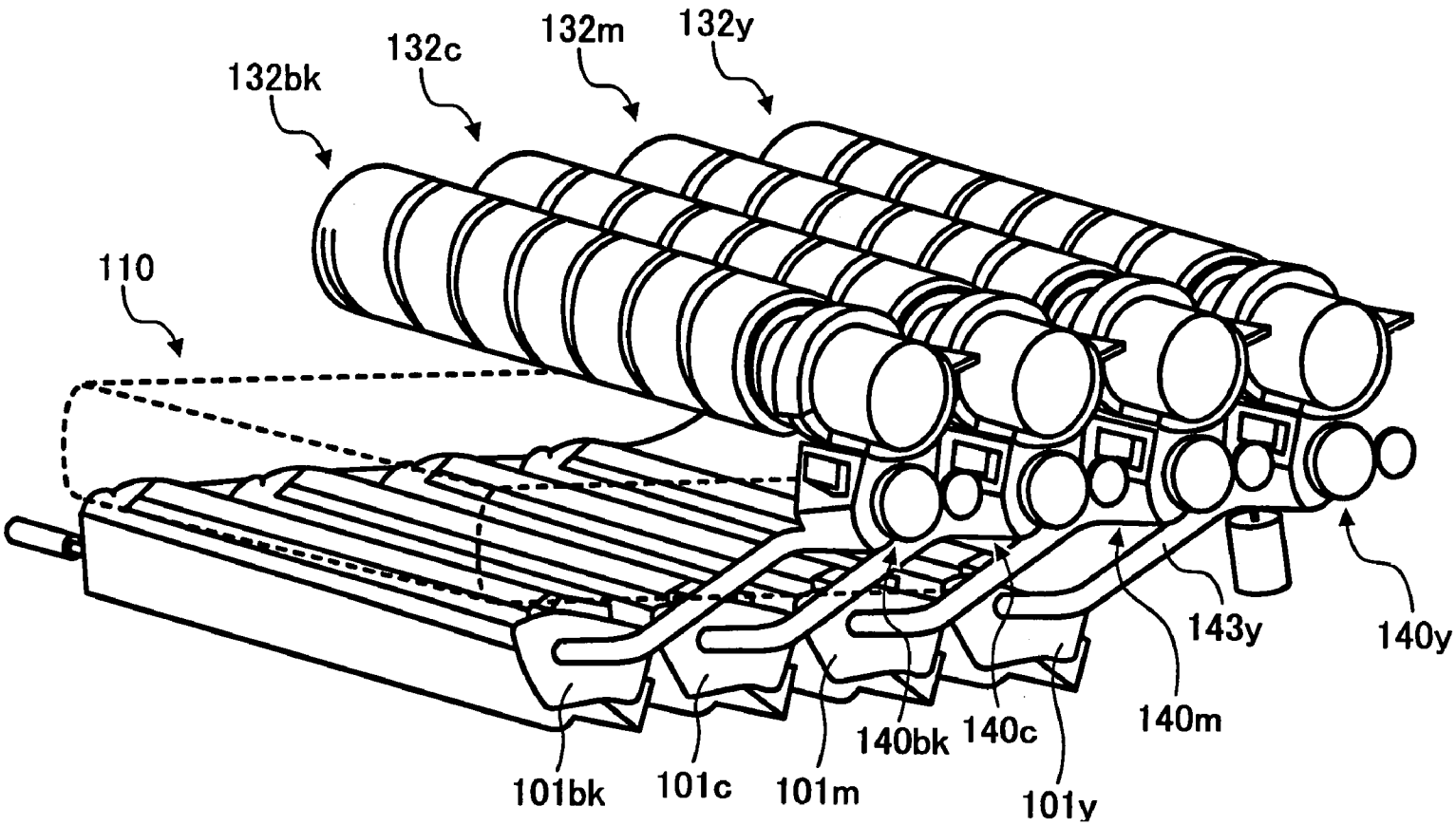
FIG. 8 is a drawing of the four toner bottles connected with respective process cartridges by the respective toner supplying units of FIG. 7.

Referring to FIGS. 7 and 8, operations of toner bottles 132*y*, 132*c*, 132*m*, and 132*bk* and the toner supplying unit 140*y* will be described. Since the toner bottles 132*y*, 132*c*, 132*m*, and 132*bk* and the toner supplying units 140*y*, 140*c*, 140*m*, and 140*bk* have identical structures, explanations of FIG. 7 is focused on a structure of the toner bottle 132*y* and the toner supplying unit 140*y*.

Operations of the toner supplying unit 140*y* is described with reference to FIG. 7. The toner supplying unit 140*y* connects the toner bottle 132*y*. The toner supplying unit 140*y* includes a drive motor 141*y*, a drive gear 142*y*, and a toner conveying pipe 143*y*.

The drive motor 141*y* is attached to the toner supplying unit 140*y*. The drive gear 142*y* is an output gear engaged with the bottle gear 137*y* provided in the toner bottle 132*y*. As previously described, the toner density sensor, provided in the developing unit 104*y*, and controlled by the controller 157*y*, detects whether or not the toner density in the developer container 107*y* is within the predetermined values. When the controller 157*y* receives a signal that the toner density is not within the predetermined values, it issues a toner supply request signal to the drive motor 141*y*. When the drive motor 141*y* runs, the drive gear 142*y* turns the bottle body 133*y*, causing the bottle gear 137*y*, and consequently the bottle body 133*y* to rotate.

The toner conveying pipe 143*y* is a tubular member including a coil (not shown). The toner falls from the toner bottle 132*y* to the toner receiver and is supplied through the toner conveying pipe 143*y* to the process cartridge 101*y*.

The toner bottle 132*y* further includes a toner guide 138*y*. The toner guide 138*y* is a spiral-shaped guiding member formed on an inner surface of the toner bottle 133*y*. When the toner bottle 133*y* is rotated, the toner guide 138*y* guides toner from the bottom of the toner bottle 137*y* toward the bottle cap 134*y*, thereby supplying toner in the toner bottle 133*y* through an opening (not shown) formed on the bottle cap 134*y* to a toner receiver (not shown) of the toner supplying unit 140*y*. The toner receiver is connected with the toner conveying pipe 143*y*. The toner conveying pipe 143*y* conveys toner from the toner bottle 132*y* to the process cartridge 101*y*. When the drive motor 141*y* runs, the toner bottle 133*y* rotates and the coil of the toner conveying pipe 143*y* rotates simultaneously. The toner fallen to the toner receiver by the rotation of the coil is conveyed through the toner conveying pipe 143*y* and supplied to the developer container 107*y* of the process cartridge 101*y*. Thus, the toner density in the developing unit 104*y* is controlled.

The toner density may be detected without using the toner density sensor. A reference image may be formed on the image bearing member 102*y*, and a light sensor or a CCD camera may count image pixels on the reference image. According to the number of image pixels, the toner is supplied.

In FIG. 8, the toner supplying units 140*y*, 140*c*, 140*m*, and 140*bk* are arranged next to the intermediate transfer belt 110 of the color printer 100 and are connected to the process cartridges 101*y*, 101*c*, 101*m*, and 101*bk*, respectively.

The toner bottles 132*y*, 132*c*, 132*m*, and 132*bk*, the toner supplying units 140*y*, 140*c*, 140*m* , and 140*bk* and the process cartridges 101*y*, 101*c*, 101*m*, and 101*bk* are closely arranged at one end of the rollers 113, 114, and 115 for supporting the intermediate transfer belt 110. With the structure as described above, the toner conveying paths to the respective process cartridges 101*y* , 101*c*, 101*m*, and 101*bk* may be made shorter, which minimizes the dimensions of the color printer 100 and reduces toner jam during a toner conveying operation. That is, the structure does not require an additional space for a toner supplying unit to be mounted to each of the process cartridges 101*y*, 101*c*, 101*m*, and 101*bk* or each of the toner bottles 132*y*, 132*c*, 132*m*, and 132*bk*. Therefore, the process cartridge 101*y*, 101*c*, 101*m*, and 101*bk* or the toner bottles 132*y*, 132*c*, 132*m*, and 132*bk* can be made smaller in size, compared to the background color printer. Further, the color printer 100 has a space to place the process cartridge 101*y*, 101*c*, 101*m*, and 101*bk* and the respective toner bottles 132*y*, 132*c*, 132*m*, and 132*bk* away from each other. Thus, the flexibility of location of the components is increased and the color printer 100 can be made smaller.

Figure 9:
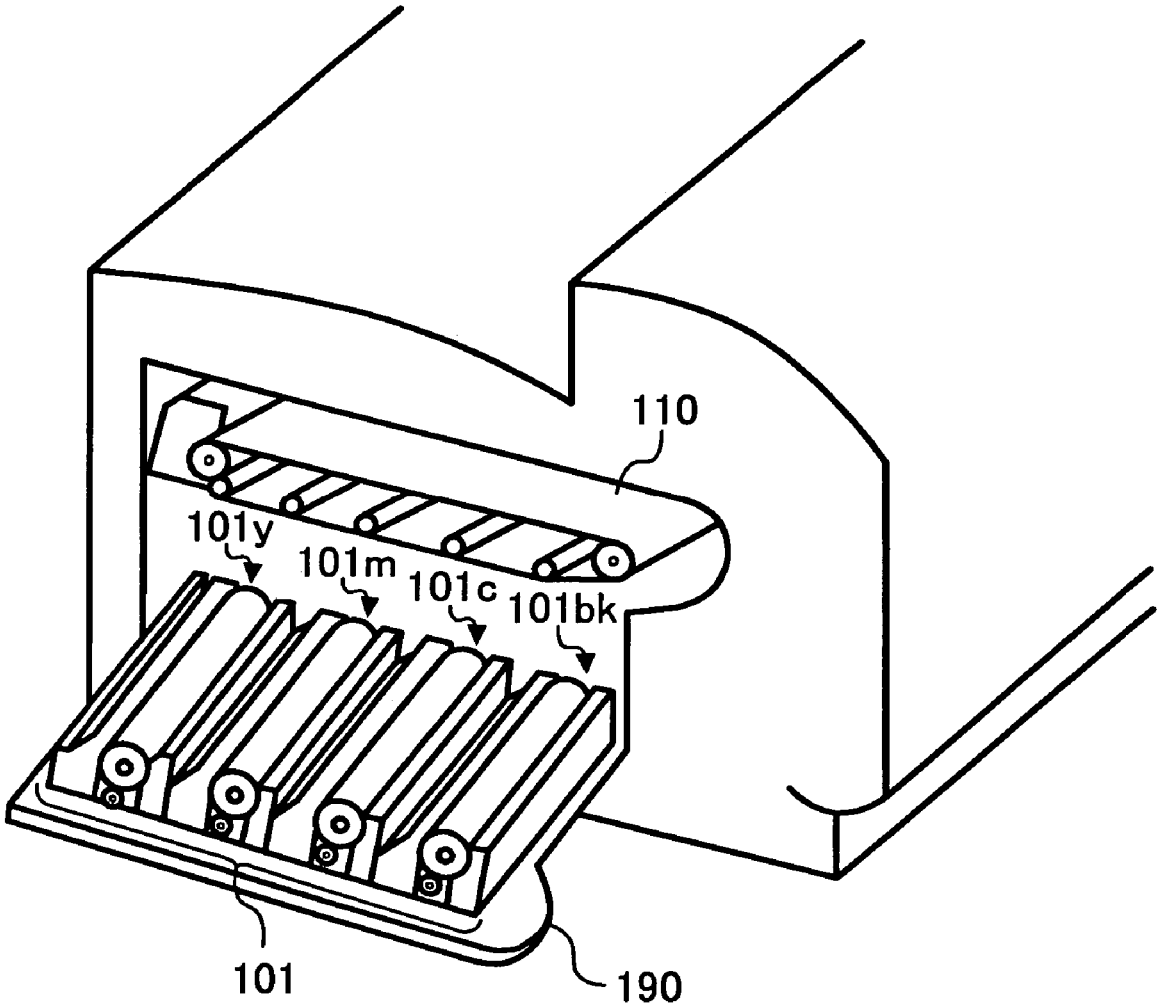
FIG. 9 is a drawing of the color printer of FIG. 3 with a front door open when four process cartridges are installed or removed guided by a guide member provided to the color printer.

Referring to FIG. 9, an installation and removal of the process cartridges 101*y*, 101*c*, 101*m*, and 101*bk* will be described. The explanation will be given for operations when the four process cartridges 101*y*, 101*c*, 101*m*, and 101*bk* are installed or removed together. Each of the process cartridges 101*y*, 101*c*, 101*m*, and 101*bk* may also be installed or removed separately or individually.

The color printer 100 includes a front cover 190 at a front side thereof and a guide member (not shown). The guide member is provided inside the color printer 100 for guiding the process cartridges 101*y*, 101*c*, 101*m*, and 101*bk* so that the process cartridges 101*y*, 101*c*, 101*m*, and 101*bk* are slidably inserted to and removed from respective predetermined positions of the color printer 100 shown in FIG. 3. When the process cartridges 101*y*,101*c*, 101*m*, and 101*bk* are installed in the color printer 100, a leading edge of each shaft of the image bearing members 102*y*, 102*c*, 102*m*, and 102*bk* is engaged with a guide groove (not shown) formed on the guide member.

To remove the process cartridges 101*y*, 101*c*, 101*m*, and 101*bk* from the respective predetermined positions, the user firstly opens the front cover 190 and pulls the four process cartridges 101*y*, 101*c*, 101*m*, and 10l*bk*. When the user pulls out the process cartridges 101*y*, 101*c*, 101*m*, and 101*bk*, the guide member guides the leading edge of each shaft of the image bearing members 102*y*, 102*c*, 102*m*, and 102*bk* to a predetermined position at which each of the image bearing members 102*y*, 102*c*, 102*m*, and 102*bk* is not operable and is ready for removal. When the user further pulls out the process cartridges 101*y*, 101*c*, 101*m*, and 101*bk*, the image bearing members 102*y*, 102*c*, 102*m*, and 102*bk* are disengaged from the respective guide grooves and are removed from the color printer 100.

To install the process cartridges 101*y*, 101*c*, 101*m*, and 101*bk*, the user mounts the process cartridges 101*y*, 101*c*, 101*m*, and 101*bk* onto the guide member and inserts the process cartridges 101*y*, 101*c*, 101*m*, and 101*bk* to the predetermined position, stopping the process cartridges 101*y*, 101*c*, 101*m*, and 101*bk* in the color printer 100. Then, the user closes the front cover 190 so that the process cartridges 101*y*, 101*c*, 101*m*, and 101*bk* are securely installed.

Figure 10:
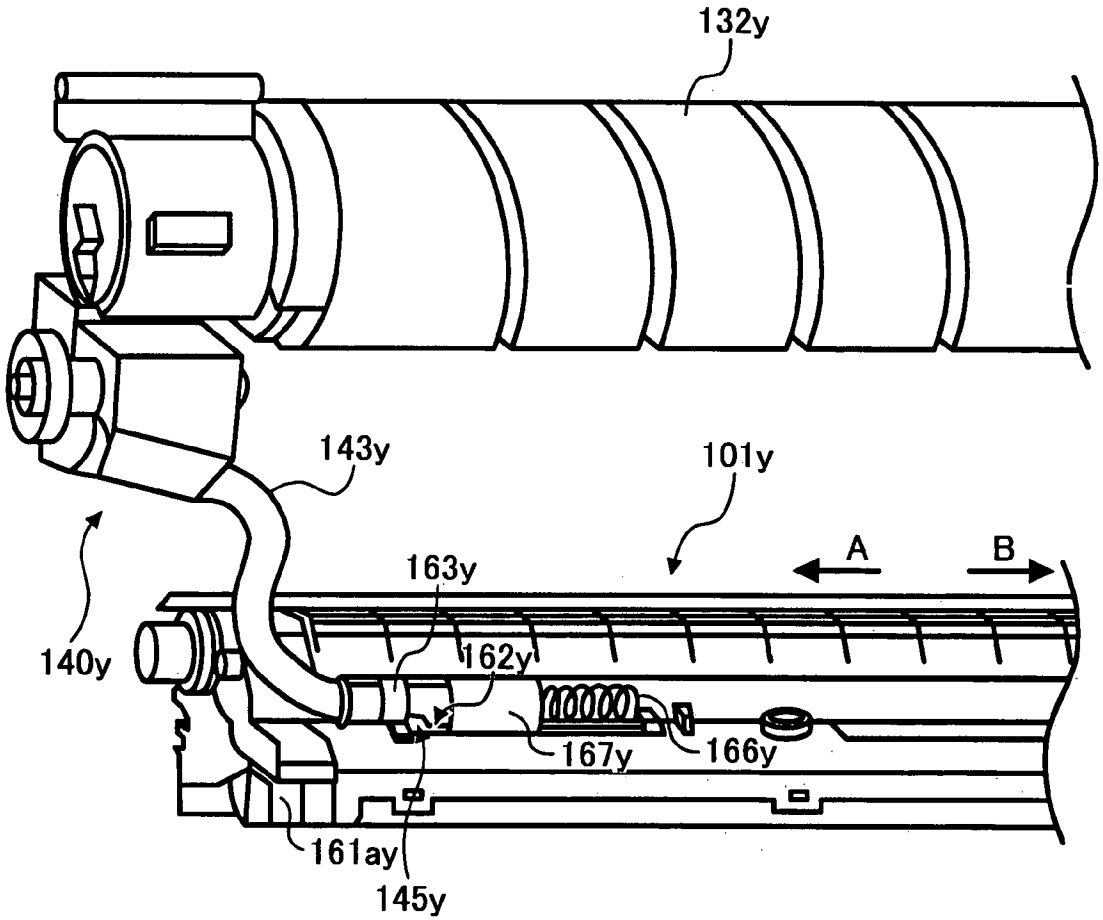
FIG. 10 is a drawing of the process cartridge, the toner bottle, and the toner supplying unit in an operational status.
Figure 11:
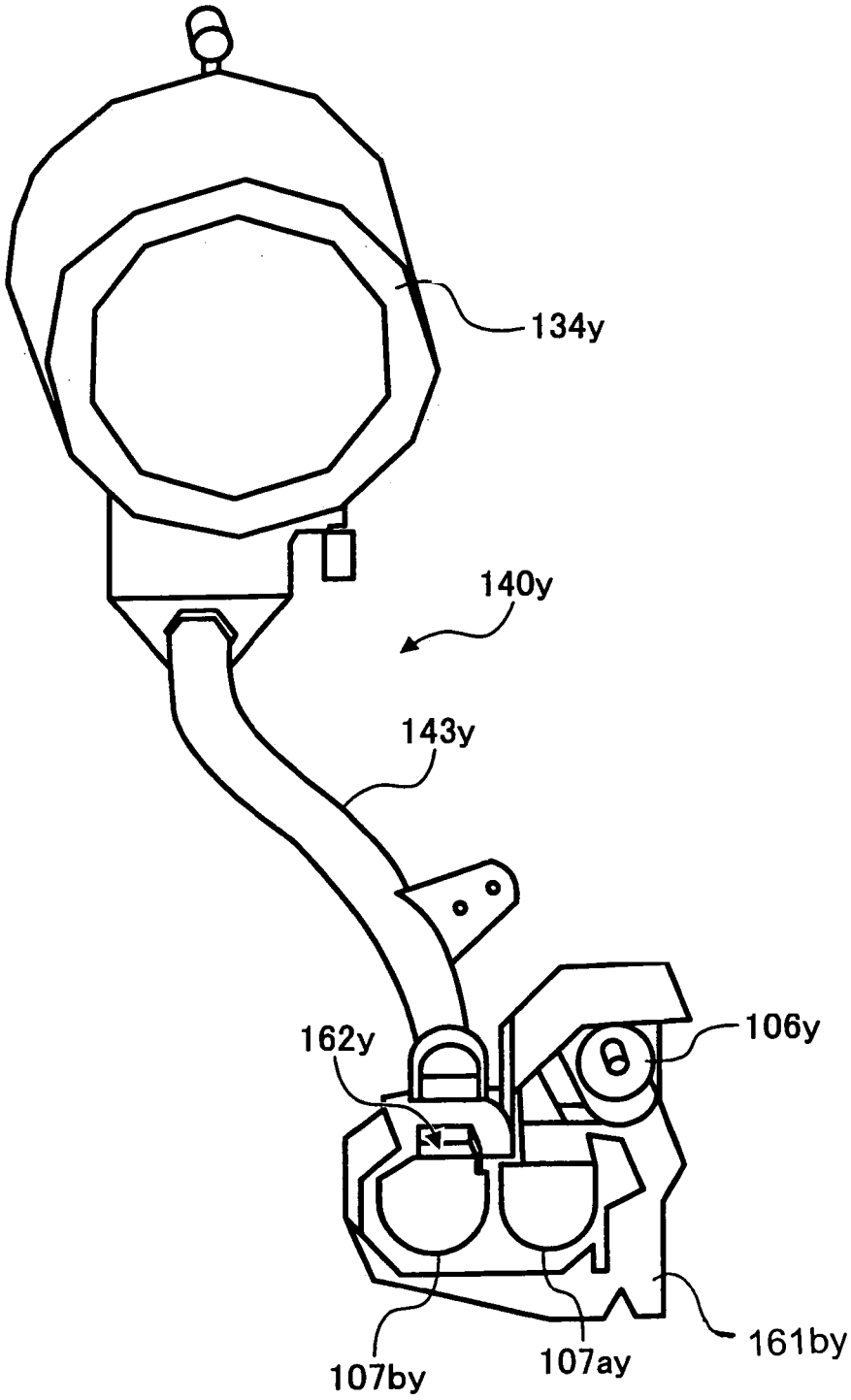
FIG. 11 is another drawing of the process cartridge engaged with the corresponding toner supplying unit of FIG. 10 viewed from another angle.

Referring to FIGS. 10 and 11, an operational status of the process cartridges 101*y*, the toner bottle 132*y*, and the toner supplying unit 140*y* will be described. The explanations will be given focusing on the toner bottle 132*y*, the process cartridge 101*y*, and the toner supplying units 140*y*. FIG. 10 shows the operational status of the color printer 100 of FIG. 3, to which the process cartridge 101*y*, and the toner bottle 132*y*are connected by means of the toner supplying unit 140*y*. FIG. 11 shows the operational status of the components of FIG. 10, viewed from another angle.

The process cartridge 101*y*of FIG. 10 includes a side plate 161*ay*, a toner inlet 162*y*, a supporting ring 163*y*, a spring 166*y*, and a toner inlet shutter 167*y*. The side plate 161*ay* is one of a pair of side plates 16l*ay* and 161*by* provided to one end of the process cartridge 101*y*. The side plate 161*by* (not shown) is provided to the other end of the process cartridge 101*y*, which is not illustrated in FIG. 10. The pair of side plates 161*ay* and 161*by* is arranged in parallel at both ends of the process cartridge 101*y*, has a predetermined width, and supports shafts of the image bearing member 102*y*, the developing sleeve 106*y*, and the first and second toner agitating screwed shafts 107*ay* and 107*by* at both ends of each shaft in a longitudinal direction. The toner inlet 162*y* is formed on an upper surface of the developer container 107*y* of FIG. 4 and is arranged within the predetermined width between the pair of side plates 161*ay* and 161*by*. With this arrangement, the process cartridge 101*y* does not have to widen the predetermined width between the pair of side plates 161*ay* and 161*by* nor to provide an additional space for a new toner supplying portion to the outside of the process cartridge 101*y*. Therefore, this prevents the process cartridge 101*y* from being larger in size.

In this embodiment, the pair of side plates 161*ay* and 161*by* are arranged in parallel to have a predetermined distance which determines a predetermined longitudinal width of the process cartridge 101*y*. The predetermined distance may be different in part due to mechanisms for supporting the components of the process cartridge 101*y* and, regardless of it, a toner inlet such as the toner inlet 162*y* is formed in an area within the predetermined longitudinal width.

The supporting ring 163*y* is a ring-shaped member and is arranged on a top surface of the developer container 107*y* of the process cartridge 101*y*. The supporting ring 163*y* is configured to pass a lower-end portion of the toner conveying pipe 143*y*.

The spring 166*y* and the toner inlet shutter 167*y* are arranged on the top surface of the developer container 107*y* and form an open/close mechanism for the toner inlet 162*y*, which will be described below with reference to FIGS. 14 and 15.

In FIG. 10, an upper-end portion of the toner supplying unit 140*y* is connected with the toner bottle 132*y* and a lower-end portion of the toner supplying unit 140*y* is connected with the process cartridge 101*y*. Each end of the upper- and lower-end portions of the toner conveying pipe 143*y* is closed. The toner supplying unit 140*y* of FIG. 10 includes a toner outlet 145*y* (FIG. 12) and a toner receiver (not shown). The toner outlet 145*y* is disposed in a bottom surface of the lower-end potion of the toner supplying pipe 143*y* facing the toner inlet 162*y* downwardly so that the toner drops by its own weight into the developer container 107*y* and is consequently conveyed from the toner outlet 145*y* to the toner inlet 162*y* of the process cartridge 101*y*.

As an alternative, a toner outlet having a different form may also be applied to the toner supplying unit 140*y*. For example, an opening provided to the lower end of the toner conveying pipe 143*y* can be used as a toner outlet.

A lower-end portion of the toner conveying pipe 143*y*, which is a pipe-shaped part, engages the toner conveying pipe 143*y* with the process cartridge 101*y* when the process cartridge 101*y*is slidably moved toward the toner conveying pipe 143*y* during the installation.

When the process cartridge 101*y* is installed in the color printer 100, the process cartridge 101*y* is slidably inserted in a direction A (FIG. 10) and is stopped when it reaches a predetermined position. At the predetermined position, the toner outlet 145*y* faces the toner inlet 162*y*. As shown in FIG. 11, the toner conveyed through the toner supplying unit 140*y* is supplied at the toner inlet 162*y* into the developer container 107*y*. When the process cartridge 101*y* is removed from the color printer 100, the process cartridge 101*y* is pulled in a direction B of FIG. 10.

Figure 12:
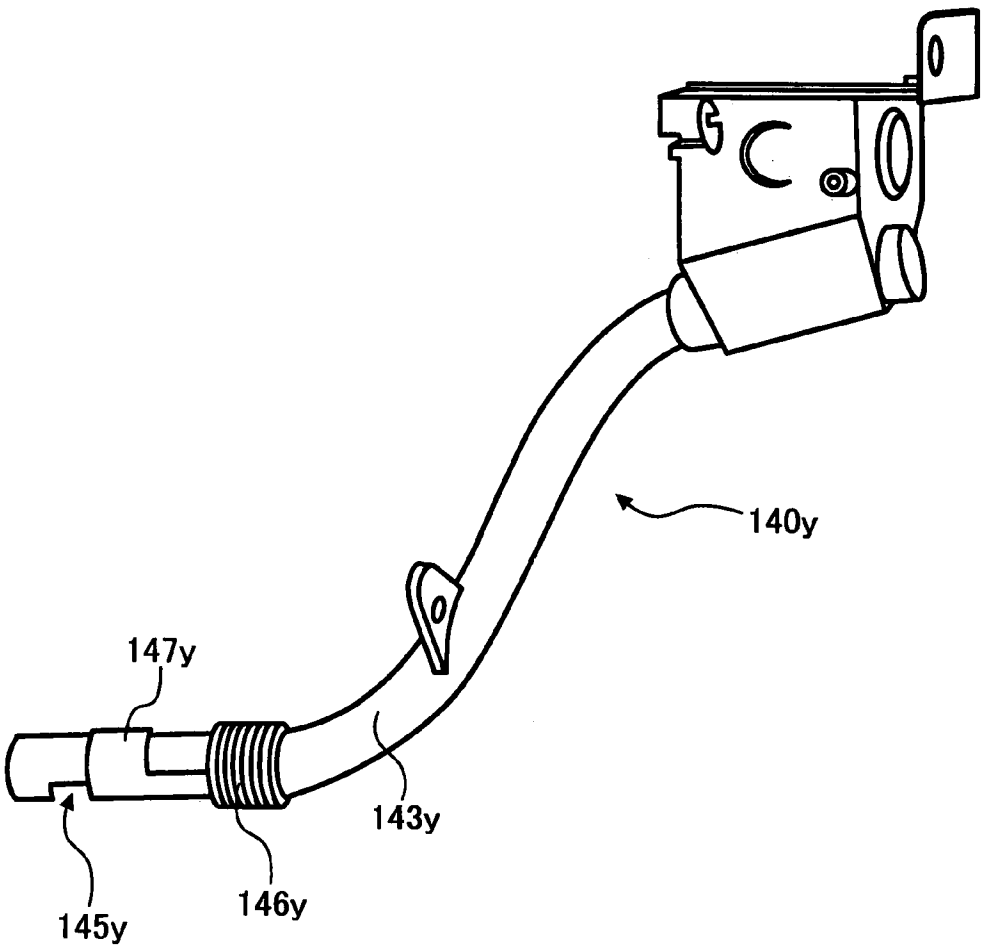
FIG. 12 is a drawing of a toner outlet, a spring, and a toner outlet shutter of the toner supplying unit when the process cartridge is installed in the color printer.
Figure 13:
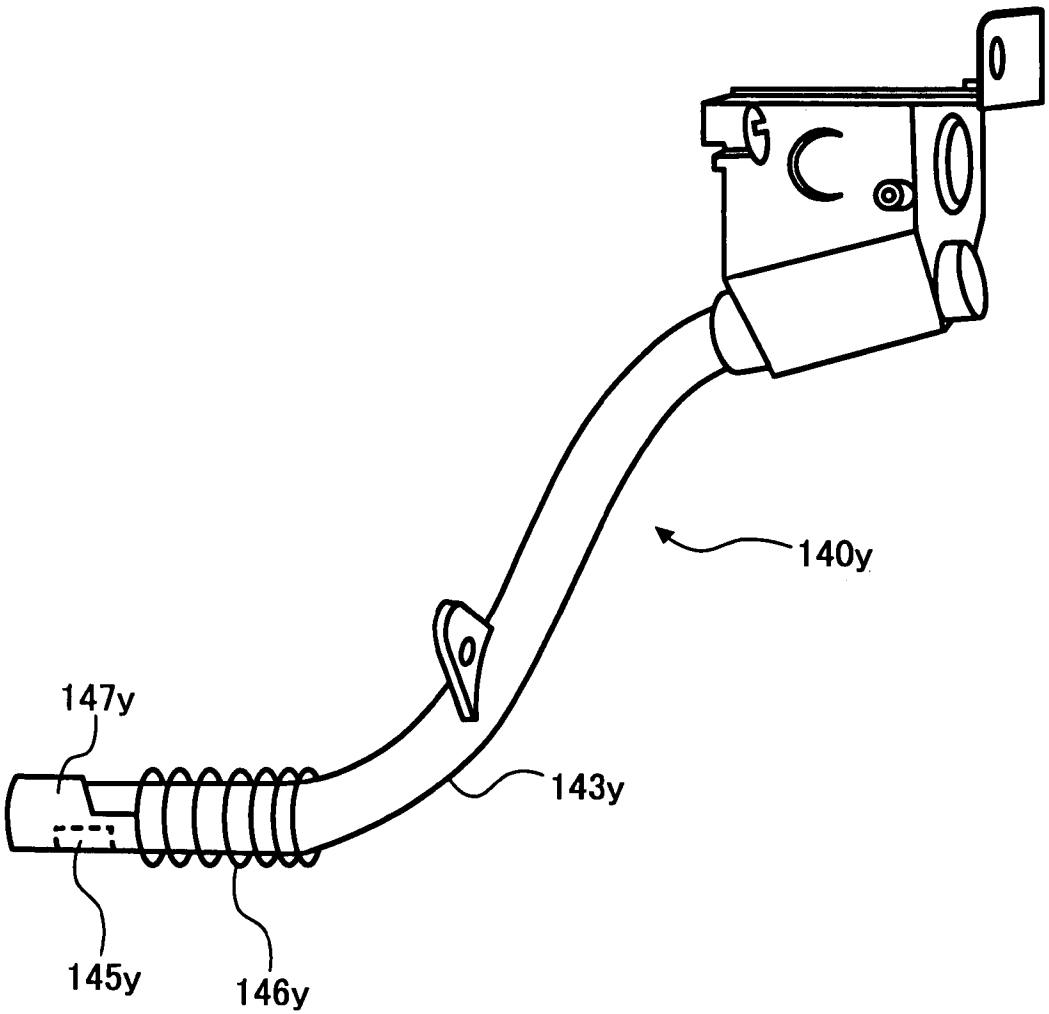
FIG. 13 is a drawing of the toner outlet, the spring, and the toner outlet shutter of the toner supplying unit when the process cartridge is removed from the color printer.

Referring now to FIGS. 12 and 13, the open/close mechanism for the toner outlet 145*y* will be described.

The toner supplying unit 140*y* further includes a spring 146*y* and a toner outlet shutter 147*y*. The spring 146*y* is arranged at a lower end of the toner conveying pipe 143*y* and is engaged with the toner outlet shutter 147*y*. The toner outlet shutter 147*y* is a tubular member and is arranged at the lower end of the toner conveying pipe 143*y* so that it can cover the toner outlet 145*y* arranged at the tubular lower-end portion of the toner conveying pipe 143*y*. The spring 146*y* and the toner outlet shutter 147*y* are configured to control the opening and closing of the toner outlet 145*y*.

When the process cartridge 101*y* is inserted to the color printer 100, the supporting ring 163*y* of FIG. 10 blocks a passage of the toner conveying pipe 143*y*. At this time, the toner outlet shutter 147*y*, provided to the lower-end portion of the toner conveying pipe 143*y*, is pressed toward the spring 146*y*, causing it to shrink, consequently exposing, the toner outlet 145*y* for supplying the toner to the toner inlet 162*y* of the process cartridge 101*y* as shown in FIG. 12.

When the process cartridge 101*y* is removed from the color printer 100, the toner conveying pipe 143*y* is separated from the supporting ring 163*y*. At this time, the toner outlet shutter 147*y* is released from the pressure applied by the supporting ring 163*y* and the spring 146*y* rebounds, pushing the toner outlet shutter 147*y* over, the toner outlet 145*y*, closing it as shown in FIG. 13.

Figure 14:
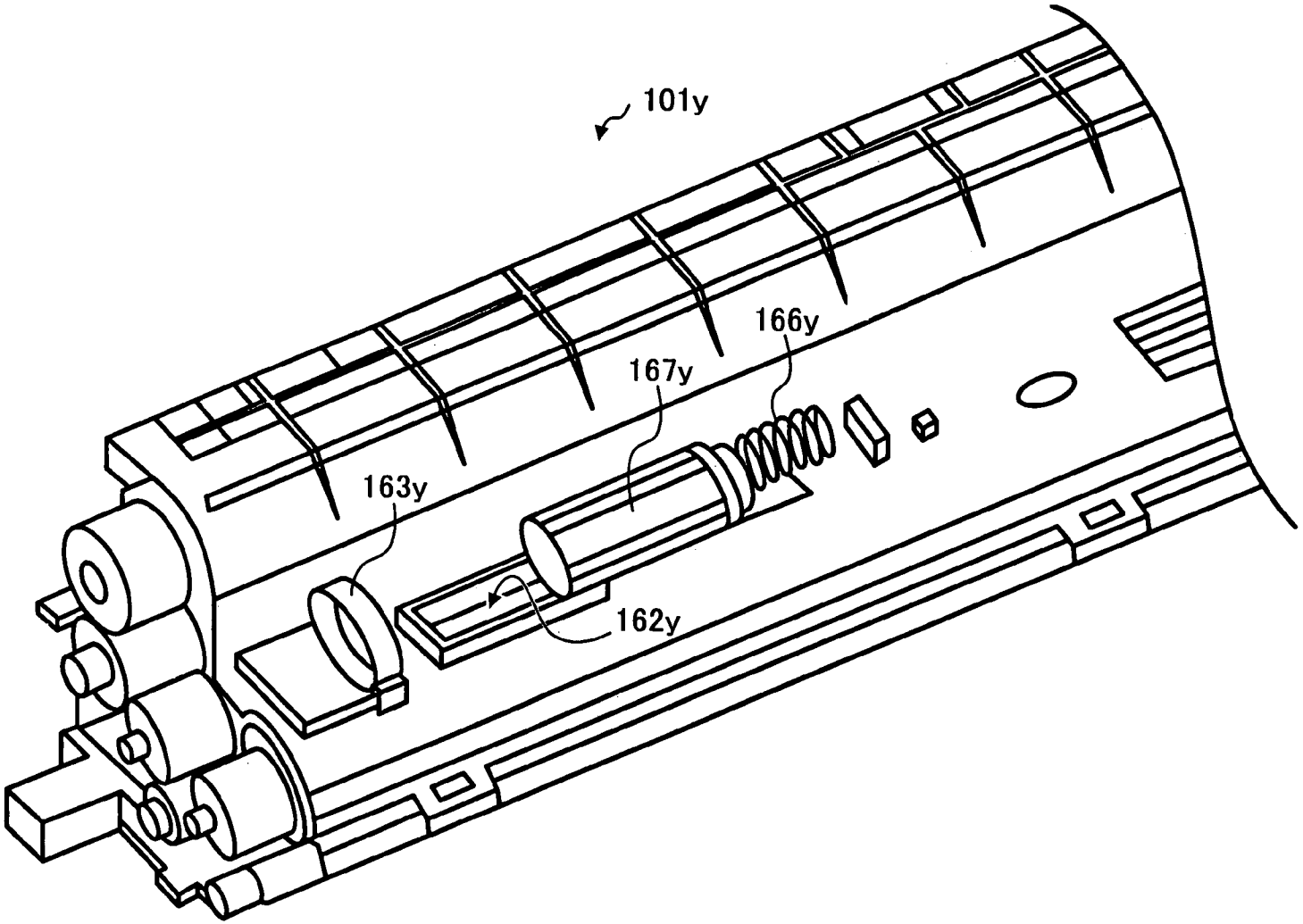
FIG. 14 is a drawing of a toner inlet shutter and a spring of the process cartridge when the process cartridge is installed in the color printer.
Figure 15:
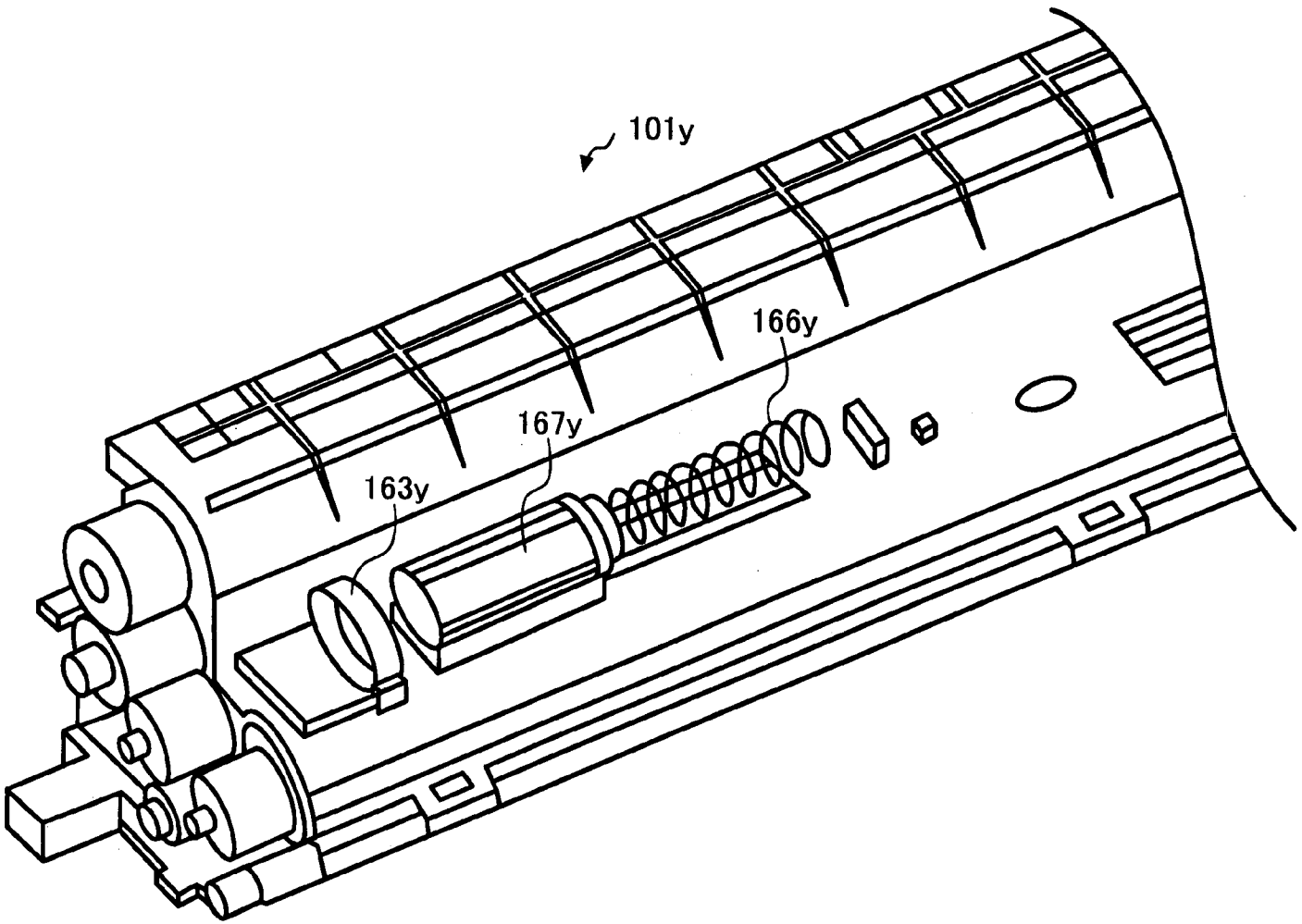
FIG. 15 is another drawing of the toner inlet shutter and the spring of the process cartridge when the process cartridge is removed from the color printer.

Referring to FIGS. 14 and 15, the open/close mechanism for the toner inlet 162*y* of the process cartridge 101*y* will be described.

As described above, the spring 166*y* and the toner inlet shutter 167*y* are configured to control the opening and closing of the toner inlet 162*y*. The spring 166*y* is engaged with the toner inlet shutter 167*y*.

When the process cartridge 101*y*is inserted in the color printer 100, the supporting ring 163*y* blocks the passage of the toner conveying pipe 143*y* as described above. As such, the toner inlet shutter 167*y*, provided on the top surface of the developer container 107*y*, is pressed by the lower-end portion of the toner conveying pipe 143*y* toward the spring 166*y*, compressing it, consequently, exposing opened the toner inlet 162*y* for receiving toner as shown in FIG. 14.

When the process cartridge 101*y* is removed from the color printer 100, the toner conveying pipe 143*y* is separated from the supporting ring 163*y* as described above. At the same time, the toner inlet shutter 167*y* is released from the pressure applied by the supporting ring 163*y* and the spring 166*y* rebounds, closing the toner inlet 162*y* with the toner inlet shutter 167*y* as shown in FIG. 15.

A sealing member (not shown), arranged at a portion of the toner outlet 145*y*, faces the toner inlet 162*y* to prevent the toner from falling from a gap which may be formed between the toner outlet 145*y* and the toner inlet 162*y*.

In other words, the open/close mechanisms for the toner outlet 145*y* and the toner inlet 162*y* operate in an interacting manner at the installation and removal of the process cartridge 101*y* with respect to the color printer 100.

When the user inserts the process cartridge 101*y* to install it in the color printer 100, the toner conveying pipe 143*y* is stopped by the supporting ring 163*y*, which presses the toner outlet shutter 147*y* to open the toner outlet 145*y*. At the same time, the toner inlet shutter 167*y* is pressed by the lower-end portion of the toner conveying pipe 143*y* to open the toner inlet 162*y*.

When the user pulls the process cartridge 101*y* out to remove it from the color printer 100, the toner conveying pipe 143*y* is released by the supporting ring 163*y*. At the same time, the toner outlet shutter 147*y* is pressed by the spring 146*y* rebounding to its original position to close the toner outlet 145*y* and the toner inlet shutter 167*y* is pressed by the spring 166*y* rebounding to its original position to close the toner inlet 162*y*.

Figure 16:
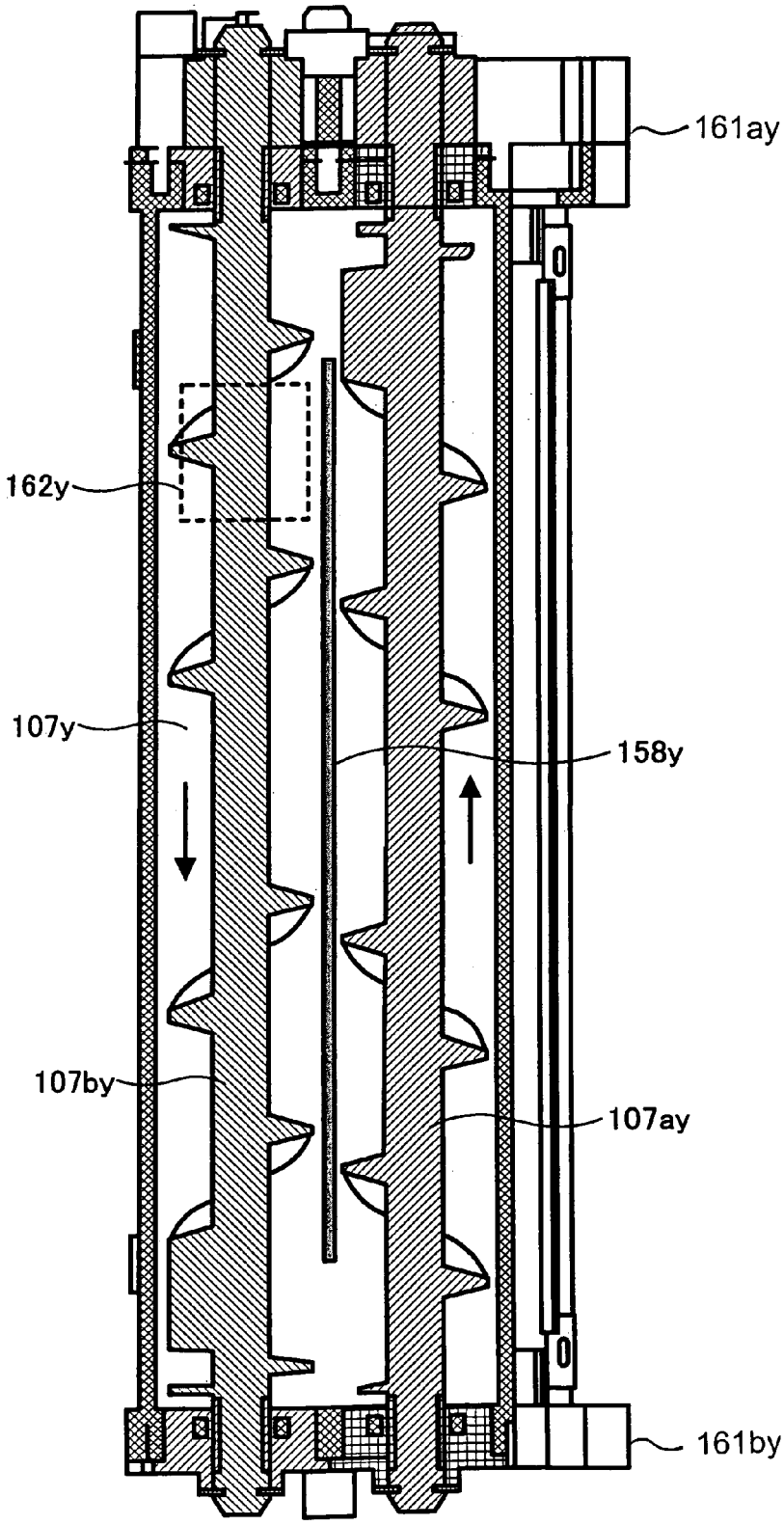
FIG. 16 is a drawing of a developer container of the process cartridge, illustrating the position of the toner inlet of FIG. 10.

Referring to FIG. 16, the developer container 107*y* will now be described. As previously described, the developer container 107*y* includes the first toner conveying screwed shaft 107*ay* and the second toner conveying screwed shaft 107*by*. The second toner conveying screwed shaft 107*by* is provided at a position away from the developing sleeve 106*y*. The toner inlet 162*y* is arranged at a position on the top surface of the process cartridge 101*y* above the second toner conveying screwed shaft 107*by*. With the structure as described above, the toner supplied to the developer container 107*y* is firstly agitated by the second toner conveying screwed shaft 107*by* followed by agitation by the first toner conveying screwed shaft 107*ay*, and is then conveyed to the developing sleeve 106*y*. Therefore, the toner is sufficiently agitated before it is conveyed to the developing sleeve 106*y*.

As shown in FIG. 16, a separator 158*y* is provided at a central position between the first and second toner conveying screwed shafts 107*ay* and 107*by* except at both end sides of each screwed shaft in a developer conveying direction. By providing the separator 158*y* to the portion as described above, a developer conveying path for the developer is partly separated. In this embodiment, the toner inlet 162*y* is arranged at a position over an area separated by the separator 158*y* in a direction where the developer travels along the developer conveying path, assuring sufficient agitation.

In a case where the toner inlet 162*y* is arranged at a position away from the area separated by the separator 158*y* and the toner is supplied through the toner inlet 162*y* over to the second toner conveying screwed shaft 107*by*, the toner may be conveyed directly to the agitating area of the first toner conveying screwed shaft 107*ay* without being agitated by the second toner conveying screwed shaft 107*by*. This is similar to the case when the toner is supplied over the first toner conveying screwed shaft 107*ay*. Both of these latter cases are likely to cause insufficiently agitated toner to be conveyed to the developing sleeve 106*y*. Therefore, by providing the toner inlet 162*y* at the position over the area separated by the separator 158*y* as previously described, the toner is sufficiently agitated by the second toner conveying screwed shaft 107*by* and then by the first toner conveying screwed shaft 107*ay* before it is conveyed to the developing sleeve 106*y*.

Next, another example of the present invention is described. The toner inlet 162*y* of FIG. 16 may be arranged at a position within a predetermined distance which determines a predetermined longitudinal width of an electrostatic latent image forming area of the image bearing member 102*y*. The electrostatic latent image forming area is within a predetermined distance which determines a predetermined longitudinal width of the pair of side plates 161*ay* and 161*by* arranged to the process cartridge 101*y*. By providing the toner inlet 162*y* at the above-described position, the process cartridge 101*y* may be further minimized.

Next, another example of the present invention is described. The toner inlet 162*y* of FIG. 16 may be arranged at a position within a predetermined distance which determines a predetermined longitudinal width of a toner image developing area of the image bearing member 102*y*. The toner image developing area is within a predetermined distance which determines a predetermined longitudinal width of the pair of side plates 161*ay* and 161*by* arranged to the process cartridge 101*y*. The toner image developing area is equal to or smaller than the electrostatic latent image forming area. By providing the toner inlet 162*y* at the above-described position, the process cartridge 101*y* may be further minimized.

What is claimed as new and desired by Letters Patent of the United States is:

1. An image forming apparatus, comprising:

a process cartridge which comprises:

an image bearing member configured to have formed on a surface thereof an electrostatic latent image;

a developer container having a toner inlet mounted on a top surface thereof;

a developer bearing member arranged in a vicinity of and in parallel with the image bearing member and configured to carry the developer to a toner image developing area formed between the image bearing member and the developer bearing member; and a pair of side plates arranged parallel to and separated from each other by a distance defining a longitudinal width of the process cartridge, the pair of side plates being configured to support the image bearing member, the developer container, and the developer bearing member;

a detachable toner storage; and a toner supplying unit configured to convey toner from the detachable toner storage to the developer container through the toner inlet, wherein the toner supplying unit further comprises:

a tubular engager mounted to a lower-end portion of the toner supplying unit and configured to slide in a direction parallel to a direction in which the process cartridge is inserted to engage the toner supplying unit; and a toner outlet arranged at a position in the lower-end portion of the toner supplying unit facing the toner inlet of the developer container of the process cartridge.

2. The image forming apparatus according to claim 1, wherein the toner inlet is located within the longitudinal width between the pair of side plates.

3. The image forming apparatus according to claim 1, wherein the toner inlet is located within the longitudinal width between the pair of side plates in an area corresponding to an electrostatic latent image forming area of the image bearing member.

4. The image forming apparatus according to claim 1, wherein the toner inlet is located within the longitudinal width between the pair of side plates in an area corresponding to a toner image developing area formed between the image bearing member and the developer bearing member.

5. The image forming apparatus according to claim 1, further comprising:

a latent image forming unit configured to emit a laser beam for irradiating the surface of the image bearing member.

6. The image forming apparatus according to claim 1, wherein the toner inlet is positioned below a top surface of the developer bearing member.

7. The image forming apparatus according to claim 1, wherein the toner supplying unit further comprises:

a toner outlet shutter movably mounted to the lower-end portion of the toner supplying unit and configured to open and close the toner outlet; and a pressing member configured to push the toner outlet shutter to close the toner outlet when the process cartridge is removed and to press the toner outlet shutter to open the toner outlet when the process cartridge is installed.

8. The image forming apparatus according to claim 7, wherein the developer container of the process cartridge further comprises:

a toner inlet shutter arranged on the top surface of the process cartridge and configured to open and close the toner inlet; and a pressing member configured to push the toner inlet shutter to close the toner inlet when the process cartridge is removed and to press the toner inlet shutter to open the toner inlet when the process cartridge is installed.

9. The image forming apparatus according to claim 1, wherein the developer container comprises:

a plurality of toner conveying screwed shafts arranged in parallel to each other and configured to agitate and convey the developer accommodated in the developer container, wherein the toner inlet is positioned on top of one toner conveying screwed shaft of the plurality of toner conveying screwed shafts not immediately next to the developer bearing member.

10. The image forming apparatus according to claim 9, wherein the developer container of the process cartridge further comprises:

at least one separating member arranged substantially centrally between two neighboring toner conveying screwed shafts and configured to separate a space between the two neighboring toner conveying screwed shafts except for end sides thereof into two oppositely directed developer conveying paths, wherein the toner inlet is positioned adjacent to the at least one separating member above one of the plurality of toner conveying screwed shafts not immediately next to the developer bearing member.

11. The image forming apparatus as in claim 1, wherein the toner supplying unit further comprises a tubular member having a coil disposed therein.

12. The image forming apparatus as in claim 11, where the coil is configured to rotate when the detachable toner storage rotates.

13. An image forming apparatus, comprising:

a process cartridge which comprises:

image bearing means for forming an electrostatic latent image in an electrostatic latent image forming area;

developer containing means for containing a developer including toner and carriers, the developer containing means comprising a toner inlet positioned on a top thereof;

developer bearing means for conveying the developer to a toner image developing area; and supporting means for supporting the image bearing means, the developer containing means, and the developer bearing means, the supporting means being separated by a distance determining a longitudinal width of the process cartridge;

toner storing means for storing toner; and toner supplying means for conveying the toner from the toner storing means to the developer containing means, wherein the toner supplying means comprises:

a tubular engager mounted to a lower-end portion of the toner supplying means and configured to slide in a direction parallel to a direction in which the process cartridge is inserted to engage the toner supplying means; and a toner outlet arranged at a position in the lower-end portion of the toner supplying means facing the toner inlet of the developer containing means of the process cartridge.

14. The image forming apparatus according to claim 13, wherein a top position of the toner inlet is located within the longitudinal width of the process cartridge.

15. The image forming apparatus according to claim 13, wherein a top position of the toner inlet is located within the longitudinal width of the process cartridge in an area corresponding to the electrostatic latent image forming area.

16. The image forming apparatus according to claim 13, wherein top position of the toner inlet is located within the predetermined longitudinal width of the process cartridge in an area corresponding to the toner image developing area.

17. The image forming apparatus according to claim 13, further comprising:

latent image forming means for emitting a laser beam for irradiating the surface of the image bearing means.

18. The image forming apparatus according to claim 13, wherein the toner inlet is arranged at a position below a top of the developer bearing means.

19. The image forming apparatus according to claim 13, wherein the toner supplying means further comprises:

toner outlet shutting means for opening and closing the toner outlet; and pressing means for pushing the toner outlet shutting means to close the toner outlet when the process cartridge is removed and for pressing the toner outlet shutting means to open the toner outlet when the process cartridge is installed.

20. The image forming apparatus according to claim 13, wherein the developer containing means further comprises:

toner inlet shutting means for opening and closing operations of the toner inlet; and pressing means for pushing the toner inlet shutting means to close the toner inlet when the process cartridge is removed and for pressing the toner inlet shutting means to open the toner inlet when the process cartridge is installed.

21. The image forming apparatus according to claim 13, wherein the developer containing means comprises:

a plurality of toner conveying screwed shafts arranged in parallel to each other and configured to agitate and convey the developer accommodated in the developer containing means, wherein the toner inlet is positioned on top of one toner conveying screwed shaft of the plurality of toner conveying screwed shafts not immediately next to the developer bearing means.

22. The image forming apparatus according to claim 21, wherein the process cartridge further comprises:

at least one separating member arranged substantially centrally between two neighboring toner conveying screwed shafts and configured to separate a space between the two neighboring toner conveying screwed shafts except for end sides thereof into two oppositely directed developer conveying paths, wherein the toner inlet is positioned adjacent to the at least one separating member above one of the plurality of toner conveying screwed shafts not immediately next to the developer bearing means.

23. A method of manufacturing an image forming apparatus, comprising:

providing a housing of a process cartridge to the image forming apparatus;

placing a pair of side plates on the housing arranged parallel to and separated from each other by a distance defining a longitudinal width of the housing of process cartridge, the pair of side plates being configured to support an image bearing member, a developer container, and a developer bearing member;

locating an image bearing member in the process cartridge, the image bearing member being configured to have formed on a surface thereof an electrostatic latent image;

locating a developer container in a vicinity of and parallel to the image bearing member, the developer container having a toner inlet mounted on a top surface thereof;

placing a developer bearing member arranged in a vicinity of and in parallel with the image bearing member and configured to carry the developer to a toner image developing area formed between the image bearing member and the developer bearing member;

installing a detachable toner storage in the image forming apparatus; and providing a toner supplying unit between the detachable toner storage and the developer container, the toner supplying unit configured to convey toner from the detachable toner storage to the developer container through the toner inlet, wherein providing the toner supplying unit further comprises:

mounting a tubular engager to a lower-end portion of the toner supplying unit and configured to slide in a direction parallel to a direction in which the process cartridge is inserted to engage the toner supplying unit; and providing a toner outlet at a position in the lower-end portion of the toner supplying unit facing the toner inlet of the developer container of the process cartridge.

24. The method of manufacturing an image forming apparatus according to claim 23, wherein the toner inlet is located within the longitudinal width between the pair of side plates.

25. The method of manufacturing an image forming apparatus according to claim 23, wherein the toner inlet is located within the longitudinal width between the pair of side plates in an area corresponding to an electrostatic latent image forming area of the image bearing member.

26. The method of manufacturing an image forming apparatus according to claim 23, wherein the toner inlet is located within the longitudinal width between the pair of side plates in an area corresponding to a toner image developing area formed between the image bearing member and the developer bearing member.

27. The method of manufacturing an image forming apparatus according to claim 23, further comprising:

placing a latent image forming unit arranged at a position to avoid obstructing the laser beam, the latent image forming unit being configured to emit a laser beam for irradiating the surface of the image bearing member.

28. The method of manufacturing an image forming apparatus according to claim 23, wherein the the toner inlet is positioned below a top surface of the developer bearing member.

29. The method of manufacturing an image forming apparatus according to claim 23, wherein providing the toner supplying unit further comprises:

mounting a toner outlet shutter to the lower-end portion of the toner supplying unit configured to open and close the toner outlet; and providing a pressing member configured to push the toner outlet shutter to close the toner outlet when the process cartridge is removed and to press the toner outlet shutter to open the toner outlet when the process cartridge is installed.

30. The method of manufacturing an image forming apparatus according to claim 23, wherein locating the developer container of the process cartridge further comprises:

mounting a toner inlet shutter arranged on the top surface of the process cartridge and configured to open and close the toner inlet; and providing a pressing member configured to push the toner inlet shutter to close the toner inlet when the process cartridge is removed and to press the toner inlet shutter to open the toner inlet when the process cartridge is installed.

31. The method of manufacturing an image forming apparatus according to claim 23, wherein locating the developer container further comprises:

providing a plurality of toner conveying screwed shafts arranged in parallel to each other and configured to agitate and convey the developer accommodated in the developer container, wherein the toner inlet is positioned on top of one toner conveying screwed shaft of the plurality of toner conveying screwed shafts not immediately next to the developer bearing member.

32. The method of manufacturing an image forming apparatus according to claim 31, wherein locating the developer container of the process cartridge further comprises:

providing at least one separating member arranged substantially centrally between two neighboring toner conveying screwed shafts and configured to separate a space between the two neighboring toner conveying screwed shafts except for end sides thereof into two oppositely directed developer conveying paths, wherein the toner inlet is positioned adjacent to the at least one separating member above one of the plurality of toner conveying screwed shafts not immediately next to the developer bearing member.

33. A process cartridge, comprising:

an image bearing member configured to have formed on a surface thereof an electrostatic latent image;

a developer container having a toner inlet mounted on a top surface thereof;

a developer bearing member arranged in a vicinity of and in parallel with the image bearing member and configured to carry the developer to a toner image developing area formed between the image bearing member and the developer bearing member; and a pair of side plates arranged parallel to and separated from each other by a distance defining a longitudinal width of the process cartridge, the pair of side plates being configured to support the image bearing member, the developer container, and the developer bearing member, wherein the process cartridge is configured to be detachably provided to an image forming apparatus which comprises: a detachable toner storage; and a toner supplying unit configured to convey toner from the detachable toner storage to the developer container through the toner inlet, wherein the toner supplying unit further comprises:

a tubular engager mounted to a lower-end portion of the toner supplying unit and configured to slide in a direction parallel to a direction in which the process cartridge is inserted to engage the toner supplying unit; and a toner outlet arranged at a position in the lower-end portion of the toner supplying unit facing the toner inlet of the developer container of the process cartridge.

34. A process cartridge, comprising:

image bearing means for forming an electrostatic latent image in an electrostatic latent image forming area;

developer containing means for containing a developer including toner and carriers, the developer containing means comprising a toner inlet positioned on a top thereof;

developer bearing means for conveying the developer to a toner image developing area; and supporting means for supporting the image bearing means, the developer containing means, and the developer bearing means, the supporting means being separated by a distance determining a longitudinal width of the process cartridge,wherein the process cartridge is configured to be detachably provided to an image forming apparatus which comprises: toner storing means for storing toner; and toner supplying means for conveying the toner from the toner storing means to the developer containing means, wherein the toner supplying means comprises:

a tubular engager mounted to a lower-end portion of the toner supplying means and configured to slide in a direction parallel to a direction in which the process cartridge is inserted to engage the toner supplying means; and a toner outlet arranged at a position in the lower-end portion of the toner supplying means facing the toner inlet of the developer containing means of the process cartridge.

35. A method of manufacturing a process cartridge, comprising:

providing a pair of side plates arranged parallel to each other within a predetermined distance which determines a predetermined longitudinal width of the process cartridge, their pair of side plates being configured to support an image bearing member, a developer container, and a developer bearing member;

locating an image bearing member between the pair of side plates, the image bearing member being configured to have formed on a surface thereof an electrostatic latent image;

locating a developer container in a vicinity of and parallel to the image bearing member, the developer container having a toner inlet mounted at a predetermined position on a top surface of the developer container and being configured to receive toner therein;

placing a developer bearing member arranged in a vicinity of and in parallel with the image bearing member and configured to carry the developer to a toner image developing area formed between the image bearing member and the developer bearing member; and locating a toner supplying unit configured to convey toner to the developer container bearing member, the toner supplying unit comprising:

a tubular engager disposed at a lower-end portion of the toner supplying unit and configured to slide in a direction parallel to a direction in which the process cartridge is inserted to engage the toner supplying unit; and locating a toner outlet at a position in the lower-end portion of the toner supplying unit facing the toner inlet of the developer container of the process cartridge.

36. An image forming apparatus, comprising:

a process cartridge which comprises:

an image bearing member configured to have formed on a surface thereon an electrostatic latent image, a developer container having a toner inlet mounted on a top surface thereof, and a developer bearing member arranged in a vicinity of and in parallel, with the image bearing member and configured to carry the developer to a toner image developing area formed between the image bearing member and the developer bearing member;

a detachable toner storage;

a toner supplying unit having a toner outlet mounted at a lower-end position thereof and configured to convey toner from the detachable toner storage to the developer container through the toner inlet;

a first shutter slidably disposed at the toner inlet of the developer container in a parallel direction with respect to a shaft of the image bearing member; and a second shutter slidably disposed at the toner outlet of the toner supplying unit in a parallel direction with respect to the shaft of the image bearing member, wherein the toner supplying unit further comprises:

a tubular engager mounted to a lower-end portion of the toner supplying unit and configured to slide in a direction parallel to a direction in which the process cartridge is inserted to engage the toner supplying unit; and a toner outlet arranged at a position in the lower-end portion of the toner supplying unit facing the toner inlet of the developer container of the process cartridge.

37. The image forming apparatus according to claim 36, wherein the toner inlet is located within a longitudinal width between a pair of side plates.

38. The image forming apparatus according to claim 36, wherein the toner inlet is located within a longitudinal width between a pair of side plates in an area corresponding to an electrostatic latent image forming area of the image bearing member.

39. The image forming apparatus according to claim 36, wherein the toner inlet is located within a longitudinal width between a pair of side plates in an area corresponding to a toner image developing area formed between the image bearing member and the developer bearing member.

40. The image forming apparatus according to claim 36, further comprising:

a latent image forming unit configured to emit a laser beam for irradiating the surface of the image bearing member.

41. The image forming apparatus according to claim 36, wherein the toner inlet is positioned below a top surface of the developer bearing member.

42. The image forming apparatus according to claim 36, wherein the developer container comprises:

a plurality of toner conveying screwed shafts arranged in parallel to each other and configured to agitate and convey the developer accommodated in the developer container, wherein the toner inlet is positioned on top of one toner conveying screwed shaft of the plurality of toner conveying screwed shafts not immediately next to the developer bearing member.

43. The image forming apparatus according to claim 42, wherein the developer container of the process cartridge further comprises:

at least one separating member arranged substantially centrally between two neighboring toner conveying screwed shafts and configured to separate a space between the two neighboring toner conveying screwed shafts except for end sides thereof into two oppositely directed developer conveying paths, wherein the toner inlet is positioned adjacent to the at least one separating member above one of the plurality of toner conveying screwed shafts not immediately next to the developer bearing member.

* * * * *